US012371298B2

(12) United States Patent
Morinaga et al.

(10) Patent No.: US 12,371,298 B2
(45) Date of Patent: Jul. 29, 2025

(54) SHEET FOLDER, IMAGE FORMING APPARATUS INCORPORATING THE SHEET FOLDER, AND IMAGE FORMING SYSTEM INCORPORATING THE SHEET FOLDER

(71) Applicants: Takuya Morinaga, Tokyo (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Yuji Suzuki, Kanagawa (JP); Wataru Nozaki, Kanagawa (JP); Kanako Fujisaki, Kanagawa (JP); Jun Yamada, Kanagawa (JP)

(72) Inventors: Takuya Morinaga, Tokyo (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Yuji Suzuki, Kanagawa (JP); Wataru Nozaki, Kanagawa (JP); Kanako Fujisaki, Kanagawa (JP); Jun Yamada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/415,680

(22) Filed: Jan. 18, 2024

(65) Prior Publication Data

US 2024/0246787 A1 Jul. 25, 2024

(30) Foreign Application Priority Data

Jan. 23, 2023 (JP) ..... 2023-008319

(51) Int. Cl.
*B65H 45/20* (2006.01)
*B65H 7/20* (2006.01)
*B65H 45/14* (2006.01)

(52) U.S. Cl.
CPC ..... *B65H 45/147* (2013.01); *B65H 7/20* (2013.01); *B65H 2701/13212* (2013.01)

(58) Field of Classification Search
CPC ..... B65H 29/52; B65H 37/06; B65H 2701/11232; B65H 2404/63; B65H 2801/24; B65H 2801/03; B65H 2801/27
(Continued)

(56) References Cited

U.S. PATENT DOCUMENTS 6,526,256 B2 * 2/2003 Yoshie ..... B65H 45/18 399/407
9,108,821 B2 * 8/2015 Nakada ..... B65H 45/12
(Continued)

FOREIGN PATENT DOCUMENTS

EP 2 810 905 A1 12/2014
JP H04-116064 A 4/1992
(Continued)

OTHER PUBLICATIONS

Extended European Search Report issued Jun. 24, 2024 in European Patent Application No. 24151346.4, 7 pages.

*Primary Examiner* — Leslie A Nicholson, III
(74) *Attorney, Agent, or Firm* — XSENSUS LLP

(57) ABSTRACT

A sheet folder includes a conveyor conveying a sheet, a first folding roller and a second folding roller that form a first nip, a third folding roller forming a second nip with the second
(Continued)

folding roller, a first guide movable between a first guide posture and a first retracted posture, a second guide movable between a second guide posture and a second retracted posture, and a motor. The motor rotates the second folding roller forward to convey the sheet toward the first nip, reverse to convey the sheet toward the second nip, moves the first guide to arrange in the first guide in the first guide posture or the first retracted posture, and moves the second guide to arrange the second guide in the second guide posture or the second retracted posture.

15 Claims, 23 Drawing Sheets

(58) Field of Classification Search
USPC ..... 270/32, 39.01
See application file for complete search history.

(56) References Cited

U.S. PATENT DOCUMENTS

| | | | | |
|---|---|---|---|---|
| 9,334,140 | B2 * | 5/2016 | Watanabe | B65H 45/04 |
| 11,560,286 | B2 * | 1/2023 | Murata | B65H 45/30 |
| 11,939,183 | B2 * | 3/2024 | Kishimoto | B65H 29/58 |
| 11,987,469 | B2 * | 5/2024 | Kishimoto | B65H 45/18 |
| 2014/0141956 | A1 | 5/2014 | Suzuki et al. | |
| 2014/0364295 | A1 | 12/2014 | Watanabe et al. | |
| 2015/0360899 | A1 | 12/2015 | Takahashi et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0221787 | A1 | 8/2016 | Matsushita et al. | |
| 2016/0340144 | A1 | 11/2016 | Sakano et al. | |
| 2016/0340145 | A1 | 11/2016 | Kunieda et al. | |
| 2016/0360053 | A1 | 12/2016 | Suzuki et al. | |
| 2017/0174465 | A1 | 6/2017 | Morinaga et al. | |
| 2017/0217239 | A1 | 8/2017 | Suzuki et al. | |
| 2018/0259895 | A1 | 9/2018 | Shibasaki et al. | |
| 2020/0103811 | A1 | 4/2020 | Sugiyama et al. | |
| 2020/0239265 | A1 | 7/2020 | Suzuki et al. | |
| 2020/0307936 | A1 | 10/2020 | Sugawara et al. | |
| 2020/0307944 | A1 | 10/2020 | Shibasaki et al. | |
| 2020/0385231 | A1 | 12/2020 | Kunieda et al. | |
| 2020/0407187 | A1 | 12/2020 | Hidaka et al. | |
| 2021/0039900 | A1 | 2/2021 | Shimazu et al. | |
| 2021/0316955 | A1 | 10/2021 | Shibasaki et al. | |
| 2021/0347589 | A1 | 11/2021 | Suzuki et al. | |
| 2021/0403273 | A1 | 12/2021 | Haraguchi et al. | |
| 2022/0055855 | A1 | 2/2022 | Shinoda et al. | |
| 2022/0289512 | A1 | 9/2022 | Takahashi et al. | |
| 2022/0334523 | A1 | 10/2022 | Akiyama et al. | |
| 2022/0363088 | A1 | 11/2022 | Yoshizawa et al. | |
| 2022/0380166 | A1 | 12/2022 | Nozaki et al. | |
| 2023/0001731 | A1 | 1/2023 | Haraguchi et al. | |
| 2023/0331029 | A1 | 10/2023 | Suzuki et al. | |
| 2023/0331507 | A1 | 10/2023 | Ota et al. | |
| 2023/0391568 | A1 | 12/2023 | Nozaki | |

FOREIGN PATENT DOCUMENTS

| | | | |
|---|---|---|---|
| JP | 2005-298185 | A | 10/2005 |
| JP | 2014-101164 | A | 6/2014 |
| JP | 2015-013751 | A | 1/2015 |
| JP | 2015-016975 | A | 1/2015 |
| JP | 2020-189717 | A | 11/2020 |

* cited by examiner

SHEET FOLDER, IMAGE FORMING APPARATUS INCORPORATING THE SHEET FOLDER, AND IMAGE FORMING SYSTEM INCORPORATING THE SHEET FOLDER

CROSS-REFERENCE TO RELATED APPLICATION

This patent application is based on and claims priority pursuant to 35 U.S.C. § 119(a) to Japanese Patent Application No. 2023-008319, filed on Jan. 23, 2023, in the Japan Patent Office, the entire disclosure of which is hereby incorporated by reference herein.

BACKGROUND

Technical Field

Embodiments of the present disclosure relate to a sheet folder, an image forming apparatus, and an image forming system.

Related Art

Sheet folders are known in the related art that fold a sheet on which an image is formed by an image forming apparatus into a predetermined shape (for example, Z-fold, letter fold-out, or half-fold).

SUMMARY

This specification describes an improved sheet folder that includes a conveyor, a pair of a first folding roller and a second folding roller, a third folding roller, a first guide, a second guide, and a motor. The conveyor conveys a sheet along a main conveyance path in a conveyance direction. The pair of the first folding roller and the second folding roller is downstream from the conveyor in the conveyance direction. The first folding roller and the second folding roller are contactable with each other to form a first nip in the main conveyance path. The third folding roller is between the first nip and the conveyor in the conveyance direction and away from the main conveyance path. The third folding roller is contactable with the second folding roller to form a second nip in a branch conveyance path branched from the main conveyance path. The second nip is between the conveyor and the first nip in the conveyance direction. The first guide is between the conveyor and the first nip in the conveyance direction. The first guide is movable between a first guide posture to guide the sheet to the first nip and a first retracted posture to guide the sheet to the second nip. The second guide is between the conveyor and the first nip in the conveyance direction and faces the first guide. The second guide is farther from the third folding roller than the first guide. The second guide is movable between a second guide posture to guide the sheet to the second nip and a second retracted posture to guide the sheet to the first nip. The motor rotates the second folding roller in a forward direction to convey the sheet toward the first nip and rotates the second folding roller in a reverse direction to convey the sheet toward the second nip. The motor moves the first guide to arrange the first guide in one of the first guide posture and the first retracted posture and moves the second guide to arrange the second guide in one of the second guide posture and the second retracted posture.

This specification also describes an image forming apparatus including the sheet folder and an image forming system including the sheet folder.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
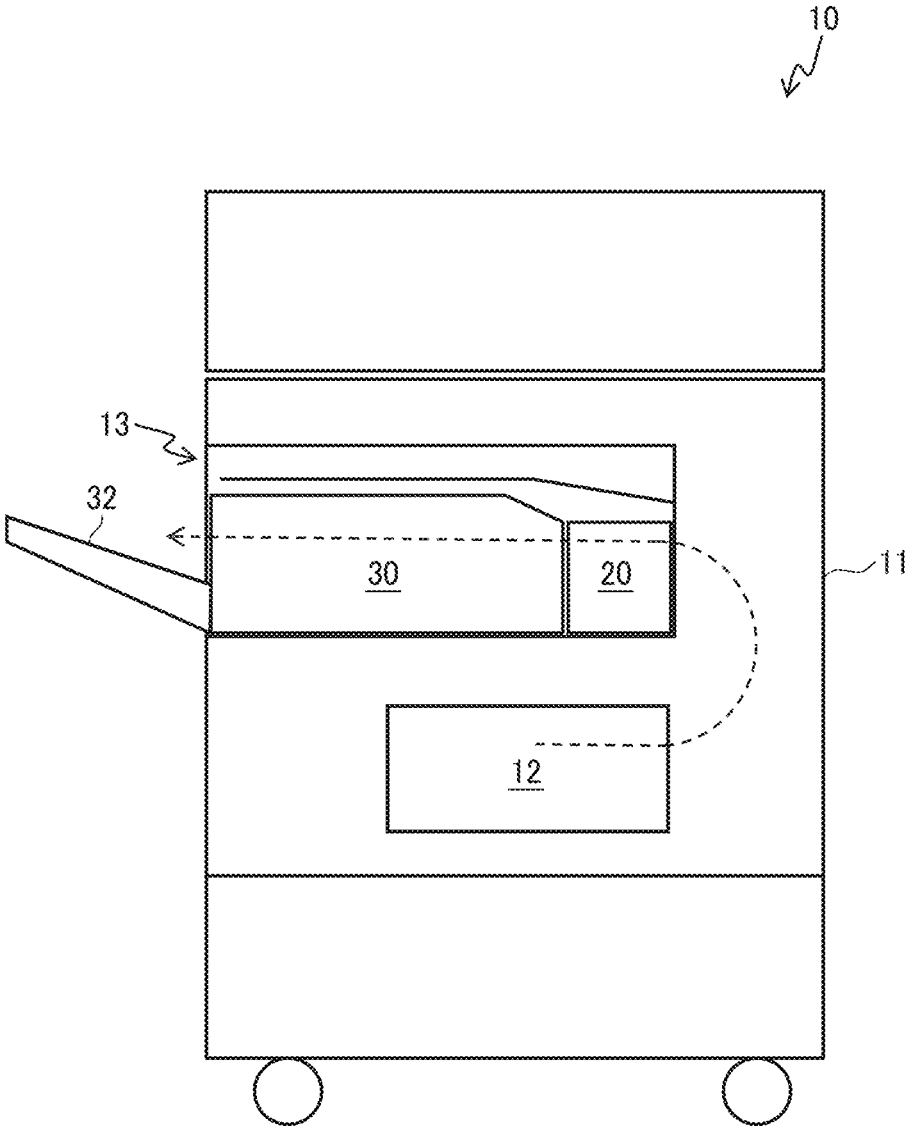
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

With reference to drawings, descriptions are given below of embodiments of the present disclosure. In the drawings illustrating embodiments of the present disclosure, elements or components having identical or similar functions or shapes are given similar reference numerals as far as distinguishable, and redundant descriptions are omitted.

A description is provided of an image forming apparatus 10 according to embodiments of the present disclosure with reference to the drawings. FIG. 1 is a schematic diagram of the image forming apparatus 10. The image forming apparatus 10 forms an image on a sheet S (typically, a paper sheet). As illustrated in FIG. 1, the image forming apparatus 10 includes a housing 11 and an image forming section 12.

The housing 11 has a box shape to form an internal space for accommodating components of the image forming apparatus 10. The housing 11 has an in-body space 13 that is accessible from the outside of the image forming apparatus 10. The in-body space 13 is located, for example, slightly above the center of the housing 11 in the vertical direction. The in-body space 13 is exposed to the outside by cutting out the outer wall of the housing 11. The in-body space 13 accommodates a sheet folder 20 as a sheet folding device, a sheet binder 30 as a post-processing device, and a puncher 50 (see FIGS. 22A and 22B) to punch a hole in the sheet that is described below.

The image forming section 12 forms an image on a sheet S stored in the tray and ejects the sheet S on which the image is formed to the sheet folder 20, the sheet binder 30, or the puncher 50. The image forming section 12 may include an inkjet image forming device that forms an image with ink or an electrophotographic image forming device that forms an image with toner. Since the image forming section 12 of FIG. 1 has a known configuration, a detailed description of the configuration and functions of the image forming section 12 is omitted.

The sheet folder 20 is in the in-body space 13 of the image forming apparatus 10 and is located downstream from the image forming section 12 and upstream from the sheet binder 30 in a conveyance passage of the sheet S from the image forming section 12 to the outside of the image forming apparatus 10 via the sheet binder 30. The conveyance passage is indicated by a dashed line and an arrow in FIG. 1. The sheet S on which the image is formed by the image forming section 12 is first delivered to the sheet folder 20 and subjected to a folding process described below and subsequently delivered to the sheet binder 30 and subjected to a binding process described below.

The sheet folder 20 is configured to be attachable to and detachable from the image forming apparatus 10. After the sheet folder 20 is removed, the sheet S on which the image is formed by the image forming section 12 is directly delivered to the sheet binder 30 and subjected to the binding process. Alternatively, the puncher 50 may be detachably attached to the position of the in-body space 13 from which the sheet folder 20 is detached. After the puncher 50 is attached, the sheet S on which the image is formed by the image forming section 12 is firstly delivered to the puncher 50 and subjected to a punching process described below and then delivered to the sheet binder 30 and subjected to the binding process. A unit attached to the position in the in-body space 13 from which the sheet folder 20 is removed is not limited to the puncher 50, and a unit performing any processing on the sheet S may be attached to the position.

Figure 2:
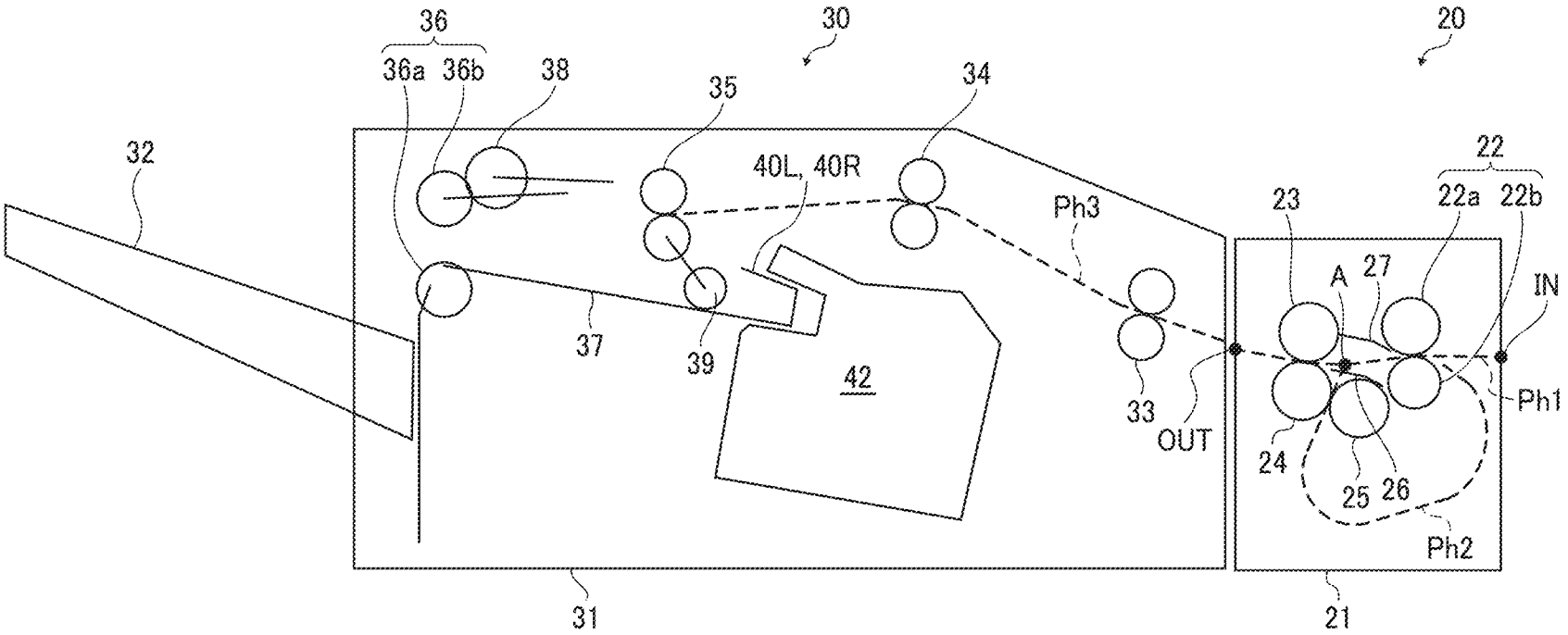
FIG. 2 is a diagram illustrating a configuration of a sheet folder and a sheet binder, according to an embodiment of the present disclosure.

FIG. 2 is a schematic diagram illustrating an internal configuration of each of the sheet folder 20 and the sheet binder 30, according to the present embodiment. Each of the sheet folder 20 and the sheet binder 30 is manufactured as a unit and has an input interface and an output interface that can be connected to each other to convey the sheet S. The input interface IN of the sheet folder 20 is configured to be connectable to an output interface of the image forming section 12. The input interface of the sheet binder 30 is configured to be connectable to the output interface of the image forming section 12 and the output interface OUT of the sheet folder 20.

The Sheet folder 20 performs the folding process that folds the sheet S on which the image is formed by the image forming section 12 into a predetermined shape (for example, Z-fold, letter fold-out, or half-fold). As illustrated in FIG. 2, the sheet folder 20 includes a housing 21, a conveyance roller pair 22 as a conveyor, a pair of a first folding roller 23 and a second folding roller 24, a third folding roller 25, a first guide plate 26 as a first guide, a second guide plate 27 as a second guide. In addition, as illustrated in FIGS. 4A and 4B, the sheet folder 20 includes a first guide-side stopper 26*a*, a first retraction-side stopper 26*b*, a second guide-side stopper 27*a*, and a second retraction-side stopper 27*b*. The sheet folder 20 also includes a driving-force transmission 28 (see FIG. 3).

The housing 21 has a box shape to form an internal space for accommodating components of the sheet folder 20. In addition, a main conveyance path Ph1 and a branch conveyance path Ph2, which are spaces through which the sheet S passes, are formed in the internal space of the housing 21. The main conveyance path Ph1 is a conveyance path from an input interface IN coupled to the image forming section 12 to an output interface OUT coupled to the sheet binder 30. In the following description, a direction from the input interface IN to the exit interface OUT on the main conveyance path Ph1 is referred to as a conveyance direction. The branch conveyance path Ph2 is a conveyance path branched from the main conveyance path Ph1 at a branch position A upstream from a nip between the first folding roller 23 and the second folding roller 24 in the conveyance direction. The nip between the first folding roller 23 and the second folding roller 24 is referred as a first nip below. At the first nip, the sheet S is nipped by the first folding roller 23 and the second folding roller 24. An end of the branch conveyance path Ph2 opposite to the branch position A is closed (that is, a dead end).

The conveyance roller pair 22 conveys the sheet S along the main conveyance path Ph1 in the conveyance direction. The conveyance roller pair 22 is configured by a driving roller 22*a* and a driven roller 22*b* that face each other via the main conveyance path Ph1 and are arranged upstream from the branch position A in the conveyance direction. The driving roller 22*a* and the driven roller 22*b* are rotatably supported by the housing 21. A conveyance motor 22*c* (see FIG. 7) transmits a rotational driving force to the driving roller 22*a*, and the rotational driving force rotates the driving roller 22*a* in a forward direction (clockwise in FIG. 2) to convey the sheet S in the conveyance direction. The driven roller 22*b* is disposed to face the driving roller 22*a* via the main conveyance path Ph1 and driven by the rotation of the driving roller 22*a*. Driving the conveyance motor 22*c* conveys the sheet S nipped by the driving roller 22*a* and the driven roller 22*b* along the main conveyance path Ph1 in the conveyance direction.

The first folding roller 23 is rotatably supported by the housing 21 at a position facing the main conveyance path Ph1. The second folding roller 24 is rotatably supported by the housing 21 at a position facing both the main conveyance path Ph1 and the branch conveyance path Ph2. The third folding roller 25 is rotatably supported by the housing 21 at a position facing the branch conveyance path Ph2. The first folding roller 23 and the second folding roller 24 are disposed to face each other via the main conveyance path Ph1 and are downstream from the branch position A in the conveyance direction. The second folding roller 24 and the third folding roller 25 are disposed to face each other via the branch conveyance path Ph2.

In other words, the pair of the first folding roller 23 and the second folding roller 24 is downstream from the conveyance roller pair 22 in the conveyance direction, and the first folding roller 23 and the second folding roller 24 are contactable with each other to form the first nip in the main conveyance path Ph1. The third folding roller 25 is between the first nip and the conveyance roller pair 22 in the conveyance direction. The third folding roller 25 is away from the main conveyance path Ph1 and contactable with the second folding roller 24 to form a second nip between the second folding roller 24 and the third folding roller 25 in the branch conveyance path Ph2 branched from the main conveyance path Ph1 upstream from the first nip and downstream from the conveyance roller 22 in the conveyance direction.

A first folding motor 23*a* (see FIG. 7) transmits a rotational driving force to the first folding roller 23 to rotate the first folding roller 23 in forward and reverse directions. Rotating the first folding roller 23 in the forward direction conveys the sheet S on the main conveyance path Ph1 in the conveyance direction. The reverse rotation of the first folding roller 23 is rotation in a direction opposite to the forward rotation. The first folding motor 23*a* is configured to be rotatable in forward and reverse directions to rotate the first folding roller 23 in forward and reverse directions.

A second folding motor 24*a* (see FIG. 7) transmits a rotational driving force to the second folding roller 24 to rotate the second folding roller 24 in forward and reverse directions. Rotating the second folding roller 24 in the forward direction conveys the sheet S on the main conveyance path Ph1 in the conveyance direction and causes the sheet S on the branch conveyance path Ph2 to enter the main conveyance path Ph1 through the branch position A. The reverse rotation of the second folding roller 24 is rotation in a direction opposite to the forward rotation. The second folding motor 24*a* is configured to be rotatable in forward and reverse directions to rotate the second folding roller 24 in forward and reverse directions.

A third folding motor 25*a* (see FIG. 7) transmits a rotational driving force to the third folding roller 25 to rotate the third folding roller 25 in forward and reverse directions. Rotating the third folding roller 25 in the forward direction causes the sheet S on the branch conveyance path Ph2 to enter the main conveyance path Ph1 through the branch position A. The reverse rotation of the third folding roller 25 is rotation in a direction opposite to the forward rotation. The third folding motor 25*a* is configured to be rotatable in forward and reverse directions to rotate the third folding roller 25 in forward and reverse directions. Instead of the first folding motor 23*a* and the third folding motor 25*a*, the driving-force transmission may include gears to transmit the rotational driving force of the second folding motor 24*a* to the first folding roller 23 and the third folding roller 25.

The first guide plate 26 and the second guide plate 27 are rotatably supported by the housing 21 in the vicinity of the branch position A. Specifically, the first guide plate 26 and the second guide plate 27 are disposed upstream from the first nip between the first folding roller 23 and the second folding roller 24 in the conveyance direction and downstream from the conveyance roller pair 22 in the conveyance direction. The first guide plate 26 is configured to be switchable (rotatable) between a first guide posture illustrated in FIG. 4A and a first retracted posture illustrated in FIG. 4B. The second guide plate 27 is configured to be switchable (rotatable) between a second guide posture illustrated in FIG. 4B and a second retracted posture illustrated in FIG. 4A.

The first guide plate 26 in the first guide posture guides the sheet S conveyed on the main conveyance path Ph1 in the conveyance direction and the sheet S entering the main conveyance path Ph1 from the branch conveyance path Ph2 through the branch position A to the first nip between the first folding roller 23 and the second folding roller 24. The first guide plate 26 in the first guide posture prevents the sheet S on the main conveyance path Ph1 from entering the branch conveyance path Ph2 through the branch position A. The first guide plate 26 in the first retracted posture allows the sheet S on the main conveyance path Ph1 to enter the branch conveyance path Ph2 through the branch position A. As a result, the first guide plate 26 in the first retracted posture guides the sheet S to the second nip.

The second guide plate 27 in the second guide posture guides the sheet S on the main conveyance path Ph1 to the branch conveyance path Ph2 through the branch position A. The second guide plate 27 in the second guide posture prevents the sheet S on the main conveyance path Ph1 from moving toward the conveyance roller pair 22 or the first folding roller 23 through the branch position A. As a result, the second guide plate 27 in the second guide posture guides the sheet S to the second nip. The second guide plate 27 in the second retracted posture allows the sheet S conveyed on the main conveyance path Ph1 in the conveyance direction and the sheet S entering the main conveyance path Ph1 from the branch conveyance path Ph2 through the branch position A to reach the first nip between the first folding roller 23 and the second folding roller 24. In other words, the second guide plate 27 in the second retracted posture guides the sheet S to the first nip.

The first nip between the first folding roller 23 and the second folding rollers 24 is defined as a position at which the first folding roller 23 and the second folding rollers 24 nip the sheet S on the main conveyance path Ph1. Similarly, a nip between the second folding roller 24 and the third folding roller 25 is defined as a position at which the second folding roller 24 and the third folding roller 25 nip the sheet S on the branch conveyance path Ph2. As illustrated in FIG. 4A, the first guide-side stopper 26*a* abuts against the first guide plate 26 in the first guide posture to prevent the first guide plate 26 from rotating in a direction away from the first retracted posture (that is, rotating clockwise in FIG. 4A). As illustrated in FIG. 4B, the first retraction-side stopper 26*b* abuts against the first guide plate 26 in the first retracted posture to prevent the first guide plate 26 from rotating in a direction away from the first guide posture (that is, rotating counterclockwise in FIG. 4B). As a result, the first guide plate 26 rotates only between the first guide posture and the first retracted posture (in other words, between the first guide-side stopper 26*a* and the first retraction-side stopper 26*b*). In other words, the first guide-side stopper 26*a* and the first retraction-side stopper 26*b* restrict the rotation range of the first guide plate 26.

As illustrated in FIG. 4B, the second guide-side stopper 27*a* abuts against the second guide plate 27 in the second guide posture to prevent the second guide plate 27 from rotating in a direction away from the second retracted posture (that is, rotating counterclockwise in FIG. 4B). As illustrated in FIG. 4A, the second retraction-side stopper 27*b* abuts against the second guide plate 27 in the second retracted posture to prevent the second guide plate 27 from rotating in a direction away from the second guide posture (that is, rotating clockwise in FIG. 4A). As a result, the second guide plate 27 rotates only between the second guide posture and the second retracted posture (in other words, between the second guide-side stopper 27*a* and the second retraction-side stopper 27*b*). In other words, the second guide-side stopper 27*a* and the second retraction-side stopper 27*b* restrict the rotation range of the second guide plate 27.

Figure 3:
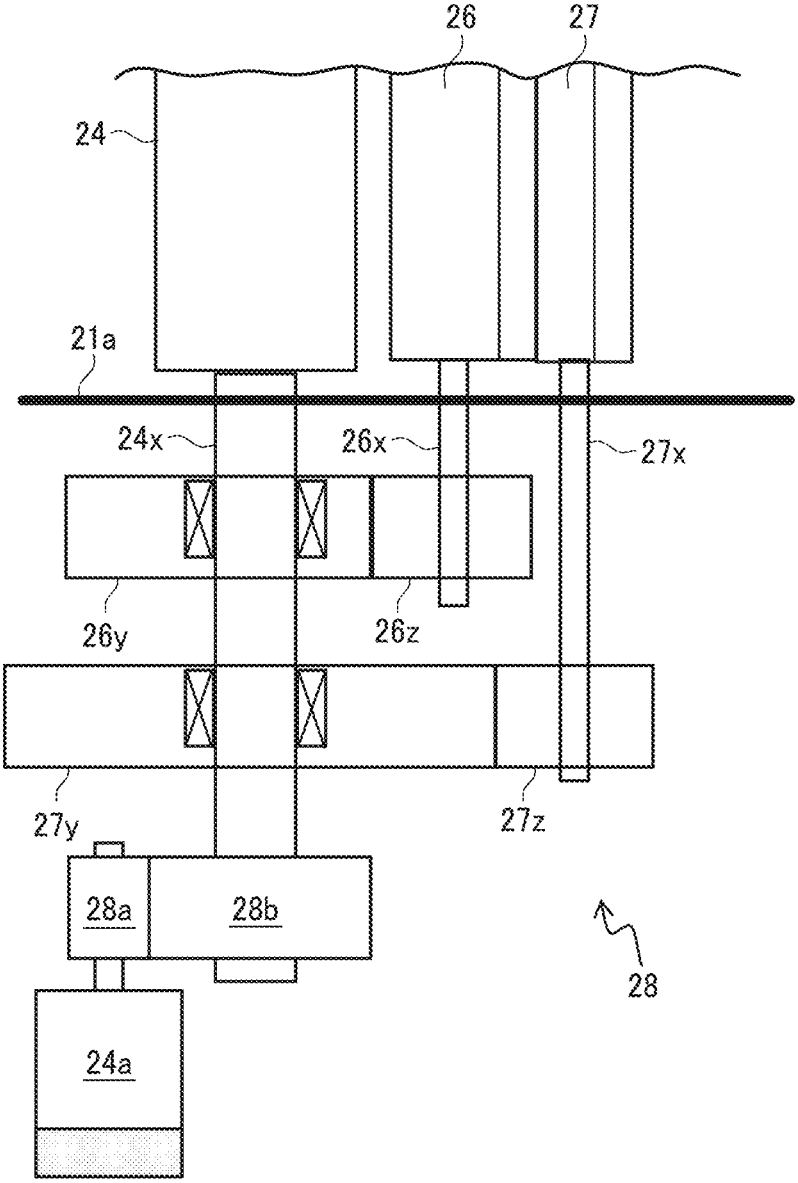
FIG. 3 is a view of a second folding roller, a first guide plate, and a second guide plate as viewed in a direction orthogonal to a sheet on a main conveyance path, according to an embodiment of the present disclosure.
Figure 4A:
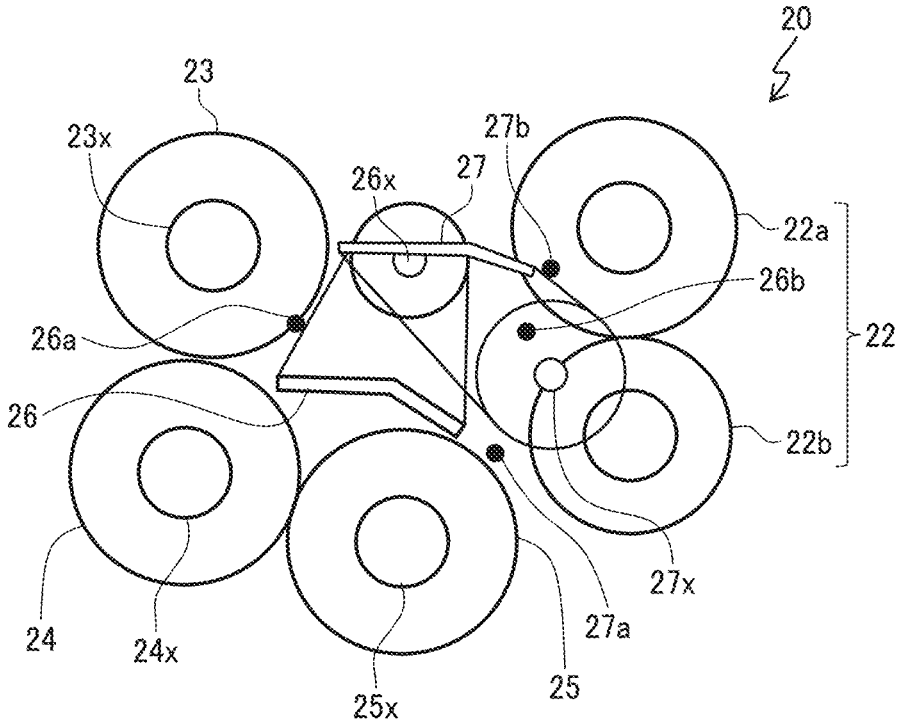
FIGS. 4A and 4B are views of a sheet folder as viewed in the width direction of the sheet, according to an embodiment of the present disclosure.
Figure 4B:
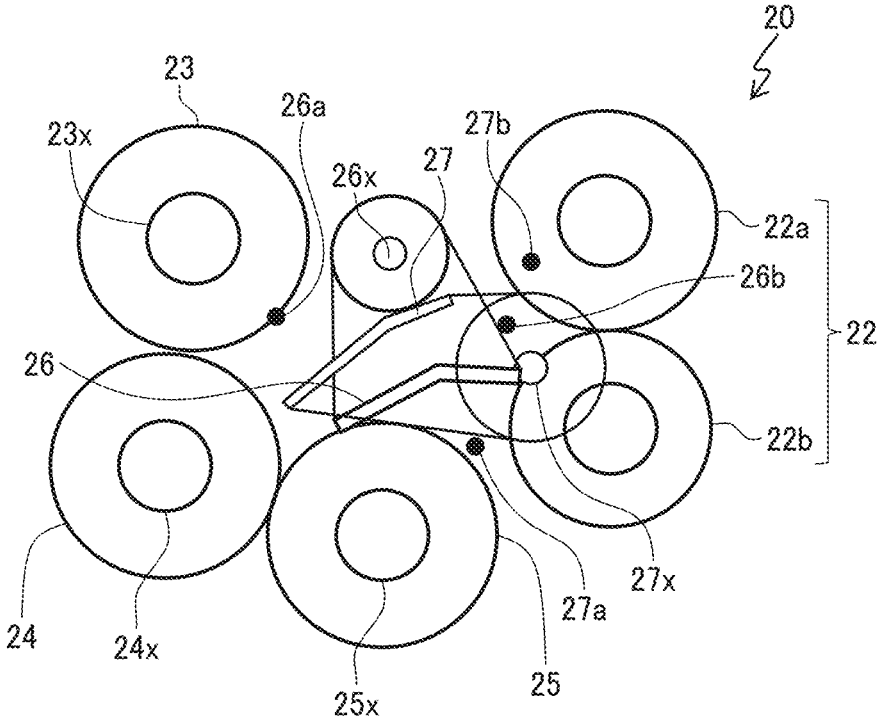
Figure 5A:
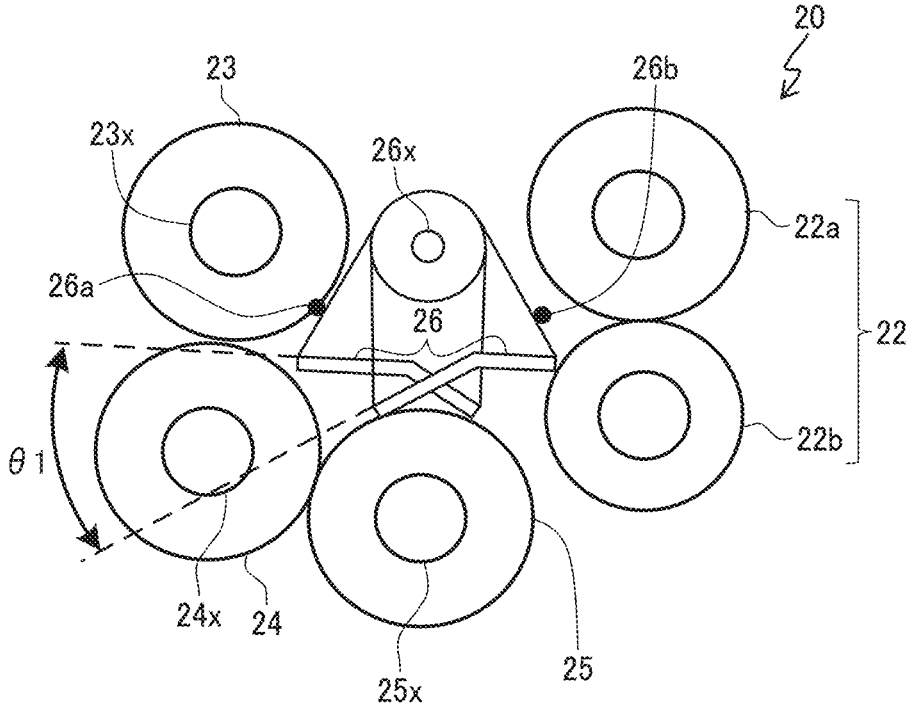
FIGS. 5A and 5B are views of a sheet folder to illustrate rotation angles of a first guide plate and a second guide plate, according to an embodiment of the present disclosure.
Figure 5B:
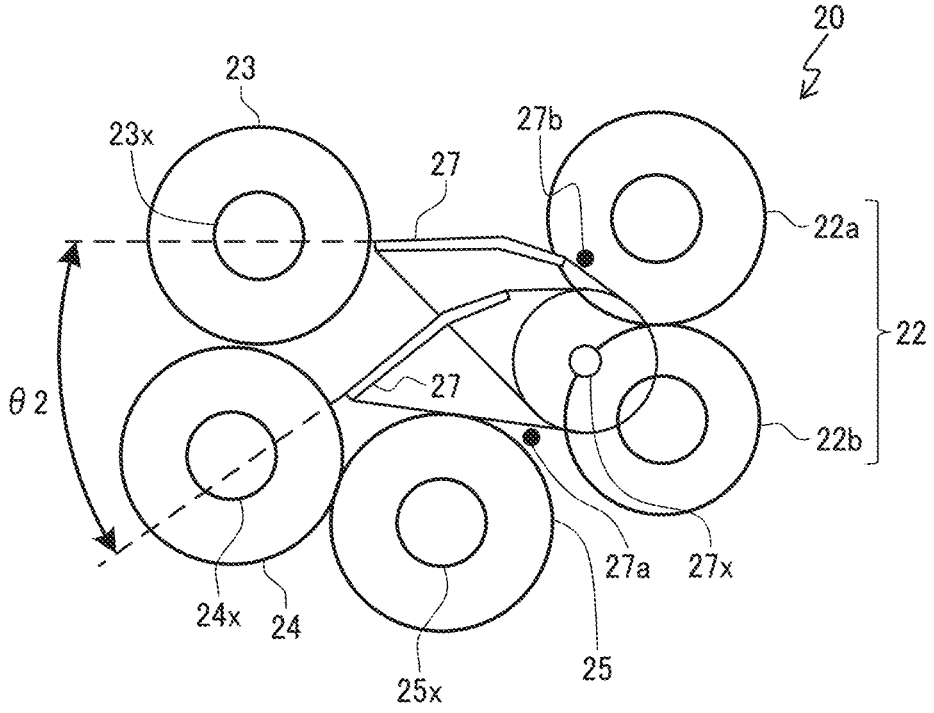
Figure 6A:
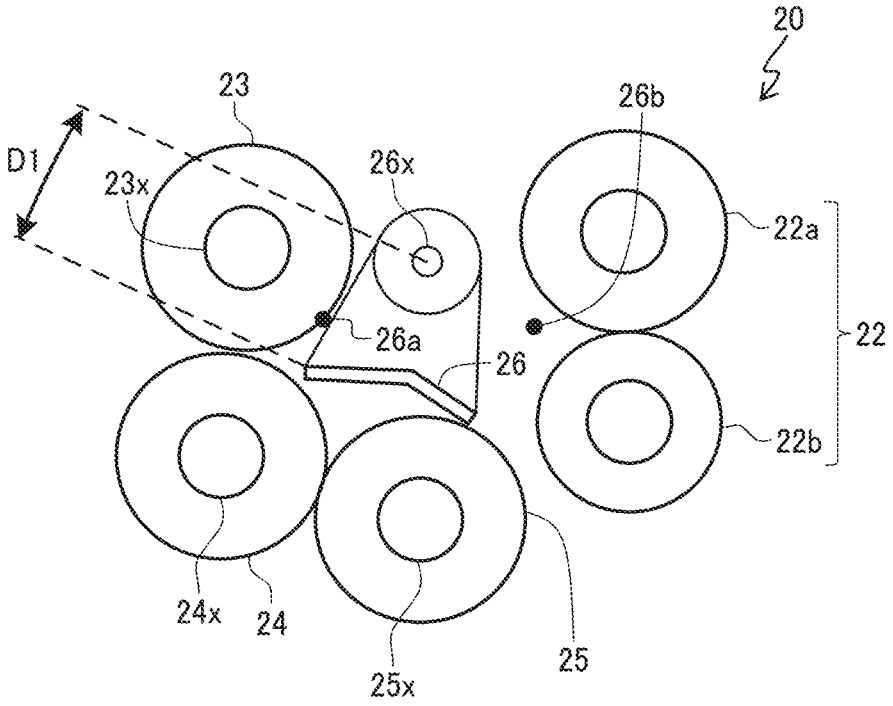
FIG. 6A is a view of a sheet folder to illustrate the distance from the rotation center of a first guide plate to a distal end of the first guide plate, according to an embodiment of the present disclosure.
Figure 6B:
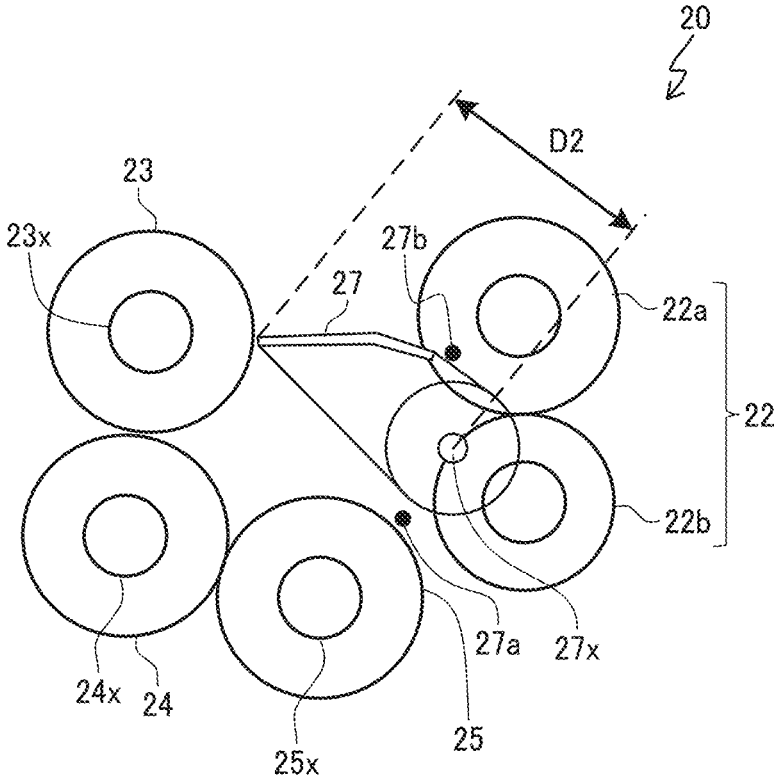
FIG. 6B is a view of a sheet folder to illustrate the distance from the rotation center of a second guide to a distal end of the second guide plate, according to an embodiment of the present disclosure.

FIG. 3 is a view of the second folding roller 24, the first guide plate 26, and the second guide plate 27 as viewed in a direction orthogonal to the sheet S on the main conveyance path Ph1, according to the present embodiment. FIGS. 4A and 4B are views of the sheet folder 20 as viewed in the width direction of the sheet S, according to the present embodiment. The width direction is orthogonal to the conveyance direction. FIG. 5A is a view of the sheet folder 20 including the first guide plate 26 at a position of FIG. 4A and the first guide plate 26 at a position of FIG. 4B to illustrate a rotation angle θ1 of the first guide plate 26, according to the present embodiment. FIG. 5B is a view of the sheet folder 20 including the second guide plate 27 at a position of FIG. 4A and the second guide plate 27 at a position of FIG. 4B to illustrate a rotation angle θ2 of the second guide plate 27. FIG. 6A is a view of the sheet folder 20 to illustrate a distance D1 from the rotation center of the first guide plate 26 to a distal end of the first guide plate 26, according to the present embodiment. FIG. 6B is a view of the sheet folder 20 to illustrate a distance D2 from the rotation center of the second guide plate 27 to a distal end of the second guide plate 27.

As illustrated in FIG. 3, the rotation shaft 24*x* of the second folding roller 24, the rotation shaft 26*x* of the first guide plate 26, and the rotation shaft 27*x* of the second guide plate 27 extend in the width direction of the sheet S. The rotation shafts 24*x*, 26*x*, and 27*x* penetrate a partition 21*a* disposed inside the housing 21. Similarly, the rotation shaft 23*x* of the first folding roller 23 and the rotation shaft 25*x* of the third folding roller 25 extend in the width direction and penetrate the partition 21*a*. The driving-force transmission 28 is disposed outside the partition 21*a*, and the first folding roller 23, the second folding roller 24, the third folding roller 25, the first guide plate 26, and the second guide plate 27 are inside the partition 21*a*.

The driving-force transmission 28 transmits the rotational driving force of the second folding motor 24*a* to the second folding roller 24, the first guide plate 26, and the second guide plate 27 to drive (in other words, rotate) the second folding roller 24, the first guide plate 26, and the second guide plate 27 in conjunction with each other. Specifically, the driving-force transmission 28 rotates the first guide plate 26 from the first retracted posture toward the first guide posture and rotates the second guide plate 27 from the second guide posture to the second retracted posture in conjunction with the forward rotation of the second folding roller 24. In addition, the driving-force transmission 28 rotates the first guide plate 26 from the first guide posture toward the first retracted posture and rotates the second guide plate 27 from the second retracted posture to the second guide posture in conjunction with the reverse rotation of the second folding roller 24. As illustrated in FIG. 3, the driving-force transmission 28 includes, for example, gears 28*a* and 28*b*, first and second torque limiter gears 26*y* and 27*y*, and first and second driven gears 26*z* and 27*z*.

An output shaft of the second folding motor 24*a* is coupled to the rotation shaft 24*x* of the second folding roller 24 via gears 28*a* and 28*b*. The first and second torque limiter gears 26*y* and 27*y* are attached to the rotation shaft 24*x* of the second folding roller 24 and rotate integrally with the second folding roller 24. The first driven gear 26*z* is attached to the rotation shaft 26*x* of the first guide plate 26 and rotates integrally with the first guide plate 26. The second driven gear 27*z* is attached to the rotation shaft 27*x* of the second guide plate 27 and rotates integrally with the second guide plate 27. The first torque limiter gear 26*y* and the first driven gear 26*z* are engaged with each other. The second torque limiter gear 27*y* and the second driven gear 27*z* are engaged with each other.

As a result, the driving-force transmission 28 transmits the rotational driving force of the second folding motor 24*a* to the second folding roller 24, in addition, to the first guide plate 26 through the first torque limiter gear 26*y* and the first driven gear 26*z*, and to the second guide plate 27 through the second torque limiter gear 27*y* and the second driven gear 27*z*. Specifically, rotating the second folding motor 24*a* in the forward direction rotates the second folding roller 24 in the forward direction, rotates the first guide plate 26 from the first retracted posture toward the first guide posture, and rotates the second guide plate 27 from the second guide posture toward the second retracted posture. On the other hand, rotating the second folding motor 24*a* in the reverse direction rotates the second folding roller 24 in the reverse direction, rotates the first guide plate 26 from the first guide posture toward the first retracted posture, and rotates the second guide plate 27 from the second retracted posture toward the second guide posture.

The first torque limiter gear 26*y* transmits the rotational driving force of the second folding motor 24*a* to the first driven gear 26*z* (in other words, the first guide plate 26) while the rotational torque is less than a threshold value (in other words, while the first guide plate 26 is separated from the first guide-side stopper 26*a* and the first retraction-side stopper 26*b*). In contrast, the first torque limiter gear 26*y* releases (i.e., idles) the transmission of the rotational driving force from the second folding motor 24*a* to the first driven gear 26*z* (in other words, the first guide plate 26) while the rotational torque is equal to or larger than the threshold value (in other words, while the first guide plate 26 is in contact with the first guide-side stopper 26*a* or the first retraction-side stopper 26*b*). The same applies to the second torque limiter gear 27*y*.

The number of teeth Z11 of the first torque limiter gear 26*y* is larger than the number of teeth Z12 of the first driven gear 26*z* (Z11>Z12). As a result, the driving-force transmission 28 increases the rotation speed of the first guide plate 26 to be larger than the rotation speed of the second folding motor 24*a*. Specifically, one rotation of the second folding motor 24*a* rotates the second folding roller 24 once as a first number of rotations and rotates the first guide plate 26 by a second number of rotations that is Z11/Z12 rotations larger than the first number of rotations. In other words, the driving-force transmission 28 transmits the rotational driving force of the second folding motor 24*a* to the first guide plate 26 at a first transmission ratio R1 (=Z11/Z12). The above-described configuration can quickly change the posture of the first guide plate 26.

Similarly, the number of teeth Z21 of the second torque limiter gear 27*y* is larger than the number of teeth Z22 of the second driven gear 27*z* (Z21>Z22). As a result, the driving-force transmission 28 increases the rotation speed of the second guide plate 27 to be larger than the rotation speed of the second folding motor 24*a*. Specifically, one rotation of the second folding motor 24*a* rotates the second folding roller 24 once as the first number of rotations and rotates the second guide plate 27 by a third number of rotations that is Z21/Z22rotations larger than the first number of rotations. In other words, the driving-force transmission 28 transmits the rotational driving force of the second folding motor 24*a* to the second guide plate 27 at a second transmission ratio R2 (=Z21/Z22). The above-described configuration can quickly change the posture of the second guide plate 27. The second number of rotations may be the same as the third number of rotations or different from the third number of rotations. In other words, the first transmission ratio R1 may be the same as the second transmission ratio R2 or different from the second transmission ratio R2.

As illustrated in FIGS. 10 to 13 and 15 to 16, the sheet S is bent when the sheet S passes through the vicinity of the branch position A. In order for the sheet S that is bent to pass through a space between the first guide plate 26 and the second guide plate 27 with a margin, a large distance between the leading ends (that is the downstream ends in the conveyance direction) of the first guide plate 26 and the second guide plate 27 is desirable. However, in FIG. 4B, the first guide plate 26 at the first retracted position is close to the third folding roller 25. In FIG. 4B, in order for the second guide plate 27 to guide the sheet S on the main conveyance path Ph1 to the branch conveyance path Ph2, it is desirable that the tip of the second guide plate 27 is close to the second nip between the second folding roller 24 and the third folding roller 25. As a result, increasing the distance between the leading ends of the first guide plate 26 and the second guide plate 27 is difficult in FIG. 4B.

In the present embodiment, the distance between the leading end of the first guide plate 26 in the first guide posture and the leading end of the second guide plate 27 in the second retracted posture illustrated in FIG. 4A is designed to be larger than the distance between the leading end of the first guide plate 26 in the first retracted posture and the leading end of the second guide plate 27 in the second guide posture illustrated in FIG. 4B. In order to satisfy the above-described relationship, a first rotation angle θ1 (illustrated in FIG. 5A) of the first guide plate 26 between the first guide posture and the first retracted posture is designed to be different from a second rotation angle θ2 (illustrated in FIG. 5B) of the second guide plate 27 between the second guide posture and the second retracted posture. Specifically, the second rotation angle θ2 is designed to be larger than the first rotation angle θ1. The positions of the first guide posture, the first retracted posture, the second guide posture, and the second retracted posture can be adjusted by the positions of the stoppers 26*a*, 26*b*, 27*a*, and 27*b*.

Corresponding to designing the first rotation angle θ1 to be different from the second rotation angle θ2, the rotational speeds of the first guide plate 26 and the second guide plate 27 may be adjusted. For example, a first distance D1 (illustrated in FIG. 6A) from the rotation center (that is a rotation shaft 26*x*) of the first guide plate 26 to the distal end of the first guide plate 26 may be designed to be different from a second distance D2 (illustrated in FIG. 6B) from the rotation center (that is a rotation shaft 27*x*) of the second guide plate 27 to the distal end of the second guide plate 27.

Specifically, the second distance D2 may be designed to be longer than the first distance D1. The above-described design can set the rotation speed of the second guide plate 27 faster than the rotation speed of the first guide plate 26.

Alternatively, the first transmission ratio R1 (=Z11/Z12) and the second transmission ratio R2 (=Z21/Z22) may be adjusted in accordance with the first rotation angle θ1 and the second rotation angle θ2. For example, the ratio (R2/R1) of the first transmission ratio R1 and the second transmission ratio R2 may be the same as the ratio (θ2/θ1) of the first rotation angle θ1 and the second rotation angle θ2 (R2/R1=θ2/θ1). In the above-described structure, rotating the second folding motor 24*a* in the forward direction moves the first guide plate 26 to the first guide position and moves the second guide plate 27 to the second retracted position at the same time. In addition, rotating the second folding motor 24*a* in the reverse direction moves the first guide plate 26 to the first retracted position and moves the second guide plate 27 to the second guide position at the same time.

As another example, the ratio (R2/R1) of the first transmission ratio R1 and the second transmission ratio R2 may be different from the ratio (θ2/θ1) of the first rotation angle θ1 and the second rotation angle θ2 (R2/R1≠θ2/θ1). The ratio (R2/R1) of the second transmission ratio R2 to the first transmission ratio R1 may be set to be larger than the ratio (θ2/θ1) of the second rotation angle θ2 to the first rotation angle θ1.

In the above-described structure, rotating the second folding motor 24*a* in the forward direction moves the second guide plate 27 to the second retracted position before the first guide plate 26 reaches the first guide position. In addition, rotating the second folding motor 24*a* in the reverse direction moves the second guide plate 27 to the second guide position before the first guide plate 26 reaches the first retracted position. On the other hand, the ratio (R2/R1) of the second transmission ratio R2 to the first transmission ratio R1 may be set to be smaller than the ratio (θ2/θ1) of the second rotation angle θ2 to the first rotation angle θ1. In the above-described structure, rotating the second folding motor 24*a* in the forward direction moves the second guide plate 27 to the second retracted position after the first guide plate 26 reaches the first guide position. In addition, rotating the second folding motor 24*a* in the reverse direction moves the second guide plate 27 to the second guide position after the first guide plate 26 reaches the first retracted position.

Figure 7:
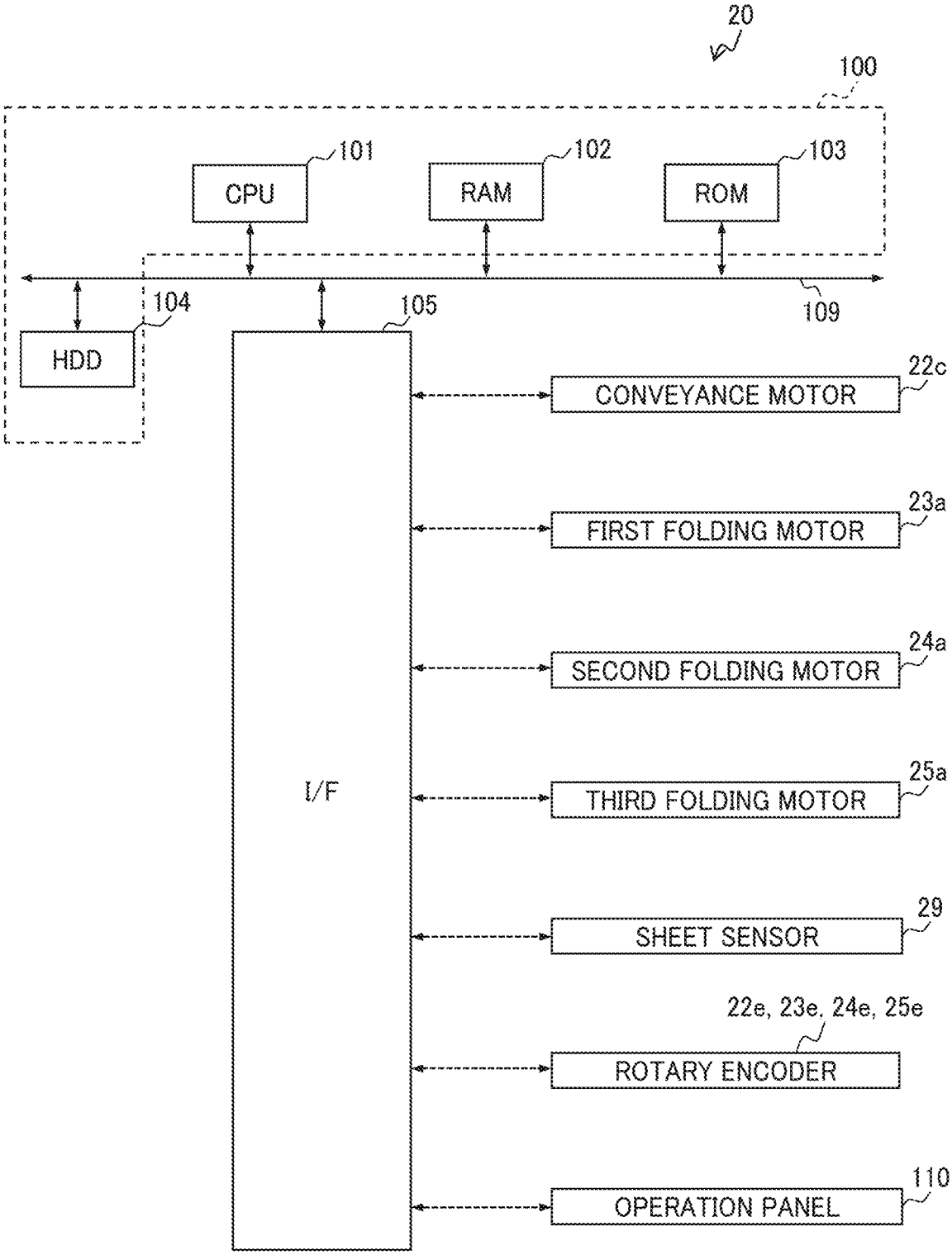
FIG. 7 is a block diagram illustrating a hardware configuration of a sheet folder according to an embodiment of the present disclosure.

The sheet folder 20 includes a sheet sensor 29 (see FIG. 7) and rotary encoders 22*e*, 23*e*, 24*e*, and 25*e* (see FIG. 7). The sheet sensor 29 detects the sheet S that has reached a predetermined position on the main conveyance path Ph1 or the branch conveyance path Ph2. The rotary encoders 22*e*, 23*e*, 24*e*, and 25*e* detect the number of rotations of the rollers 22*a*, 23, 24, and 25. A controller 100, which is described below, can determine the positions of the sheet S in the main conveyance path Ph1 and the branch conveyance path Ph2 based on results detected by the sheet sensor 29 and the rotary encoders 22*e*, 23*e*, 24*e*, and 25*e*.

Specifically, the controller 100 that serves as circuitry determines the position of the sheet S based on the numbers of pulse signals output from the rotary encoders 22*e*, 23*e*, 24*e*, and 25*e* after the sheet sensor 29 detects the sheet S. As a result, the controller 100 can determine whether the sheet S is at a position detected and determined in steps S902, S904, S906, S1402, and S1404, which are described later in detail. The position of the sheet sensor 29 is not limited to one position. Multiple sheet sensors may be at multiple positions.

The sheet binder 30 performs the binding process as post-processing that binds multiple sheets S on which images are formed by the image forming section 12. In the following description, multiple sheets S is referred to as a sheet bundle Sb. In the present embodiment, the sheet binder 30 is described as an example of the post-processing device, but the post-processing device is not limited to this. As illustrated in FIG. 2, the sheet binder 30 includes a housing 31, an output tray 32, multiple conveyance roller pairs 33, 34, 35, and 36, an internal tray 37, a tapping roller 38, a return roller 39, end fences 40L and 40R, side fences 41L and 41R (see FIG. 20), and a binder 42.

The housing 31 has a box shape to form an internal space for accommodating components of the sheet binder 30. In addition, a conveyance path Ph3 as a space through which the sheet S passes is formed in the internal space of the housing 31. The output tray 32 is supported on an outer side face of the housing 31. The output tray 32 supports the sheet S or the sheet bundle Sb conveyed by the conveyance roller pairs 33 to 36.

The conveyance roller pairs 33 to 36 are arranged on the conveying path Ph3 at predetermined intervals. The conveyance roller pairs 33 to 36 convey the sheet S along the conveyance path Ph3. The basic configuration of the conveyance roller pairs 33 to 36 is common to that of the conveyance roller pair 22 of the sheet folder 20. The conveyance roller pair 36 is configured by a driving roller 36*a* and a driven roller 36*b* that can be brought into contact with and separated from the driving roller 36*a*. The conveyance roller pair 35 may be configured to be slidable in the width direction in order to perform a sorting process that ejects the sheets S onto positions of the output tray 32 shifted in the width direction.

Multiple sheets P are sequentially conveyed on the third conveyance path Ph3 and temporarily supported and stacked on the internal tray 37. The tapping roller 38 is supported at an end of a rotation arm above the internal tray 37. As the rotation arm is rotated, the tapping roller 38 supplies the sheet S nipped by the conveyance roller pair 36 to the internal tray 37. The return roller 39 contacts the upper face of the sheet S supported by the internal tray 37 and rotates to guide the sheet S toward the end fences 40L and 40R.

The end fences 40L and 40R contact downstream ends of the sheets S supported by the internal tray 37 in the conveyance direction and align the positions of the sheets S in the conveyance direction. The side fences 41L and 41R contact both ends of the sheets S supported by the internal tray 37 in the width direction and align the positions of the sheets S in the width direction. The binder 42 performs the binding process that binds the sheet bundle Sb supported by the internal tray 37. The binding process performed by the binder 42 may be staple binding process in which inserting a binding staple into the sheet bundle Sb binds the sheet bundle Sb or pressure binding process in which deforming the sheet bundle Sb under pressure binds the sheet bundle Sb. The sheet binder 30 may include a staple binder that performs the staple binding process and a crimp binder that performs the pressure binding process, which are operable independently of each other at positions spaced apart from each other in the width direction.

In addition, the housing 31 may have a manual staple slit disposed at a position facing the binder 42. An operator may insert the sheet bundle into the binder 42 through the manual staple slit and press a manual staple button of an operation panel 110 described below, and the binder 42 performs the binding process.

FIG. 7 is a block diagram illustrating a hardware configuration of the sheet folder 20, according to the present embodiment. As illustrated in FIG. 7, the sheet folder 20 includes a central processing unit (CPU) 101, a random-access memory (RAM) 102, a read-only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic and controls the general operations of the sheet folder 20. The RAM 102 is a volatile storage medium that allows data to be read and written at high speed. The CPU 101 uses the RAM 102 as a working area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an operating system (OS), various control programs, and application programs.

In the sheet folder 20, the CPU 101 executes a control program stored in the ROM 103 and a data-processing program (application program) loaded into the RAM 102 from a recording medium such as the HDD 104 using an arithmetic function. Such processing configures a software controller including various functional modules of the sheet folder 20. The software controller thus configured cooperates with hardware resources of the sheet folder 20 to construct functional blocks that implement functions of the sheet folder 20. In other words, the CPU 101, the RAM 102, the ROM 103, and the HDD 104 construct the controller 100 as the circuitry that controls the operation of the sheet folder 20.

The I/F 105 is an interface that connects the conveyance motor 22*c*, the first folding motor 23*a*, the second folding motor 24*a*, the third folding motor 25*a*, the sheet sensor 29, the rotary encoders 22*e*, 23*e*, 24*e*, and, 25*e*, and the operation panel 110 to the common bus 109.

The controller 100 acquires data from the sheet sensor 29, the rotary encoders 22*e*, 23*e*, 24*e*, and 25*e*, and the operation panel 110 through the I/F 105, and operates the conveyance motor 22*c*, the first folding motor 23*a*, the second folding motor 24*a*, and the third folding motor 25*a*.

Although FIG. 7 illustrates only the components of the sheet folder 20, the controller 100 may also control the operations of the image forming section 12 and the sheet binder 30. Alternatively, the controller 100 as the circuitry may operate the sheet folder 20 in conjunction with the image forming section 12 and the sheet binder 30 by communicating with a controller that controls the operations of the image forming section 12 and a controller that controls the operations of the sheet binder 30.

The operation panel 110 includes an operation device that receives instructions from the operator and a display serving as an indicator that notifies the operator of information. The operation device includes, for example, physical input buttons and a touch panel overlaid on a display. The operation panel 110 acquires information from the operator through the operation device and provides the operator with information through the display. Examples of the indicator are not limited to the display and may be, for example, a light-emitting diode (LED) lamp or a speaker.

Figure 8A:
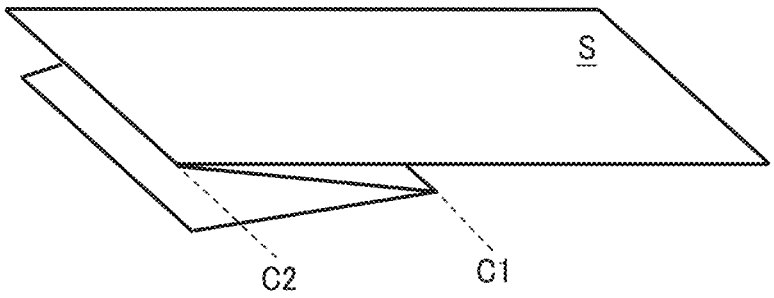
FIGS. 8A to 8C are perspective views of sheets to illustrate various folding methods that can be achieved by a sheet folder according to an embodiment of the present disclosure.
Figure 8B:
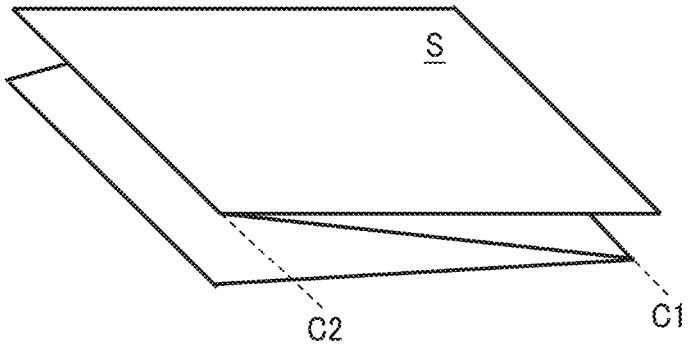
Figure 8C:
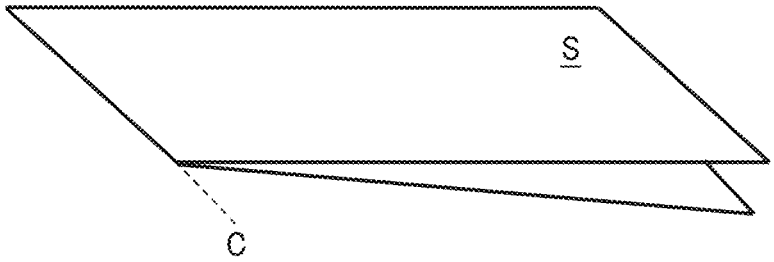

FIGS. 8A to 8C are perspective views of sheets S to illustrate various folding methods that can be achieved by the sheet folder 20 according to the present embodiment. FIG. 8A is a perspective view of the sheet folded by a so-called Z-fold. In the Z-fold, the sheet S having the total length L in the conveyance direction is folded at a first fold position C1 at L/4 from the leading edge of the sheet S and subsequently folded at a second fold position C2 at L/2 from the leading edge of the sheet S in an opposite direction. The second fold position C2 is upstream from the first fold position C1 in the conveyance direction. FIG. 8B is a perspective view of the sheet folded by a so-called letter fold-out. In the letter fold-out, the sheet S having the total length L in the conveyance direction is folded at a first fold position C1 at L/3 from the leading edge of the sheet S and subsequently folded at a second fold position C2 at 2L/3 from the leading edge of the sheet S in an opposite direction. The second fold position C2 is upstream from the first fold position C1 in the conveyance direction. FIG. 8C is a perspective view of the sheet folded by a so-called half-fold. In the half-fold, the sheet S having the total length L in the conveyance direction is folded at a fold position C at L/2 from the leading edge of the sheet S.

Figure 9:
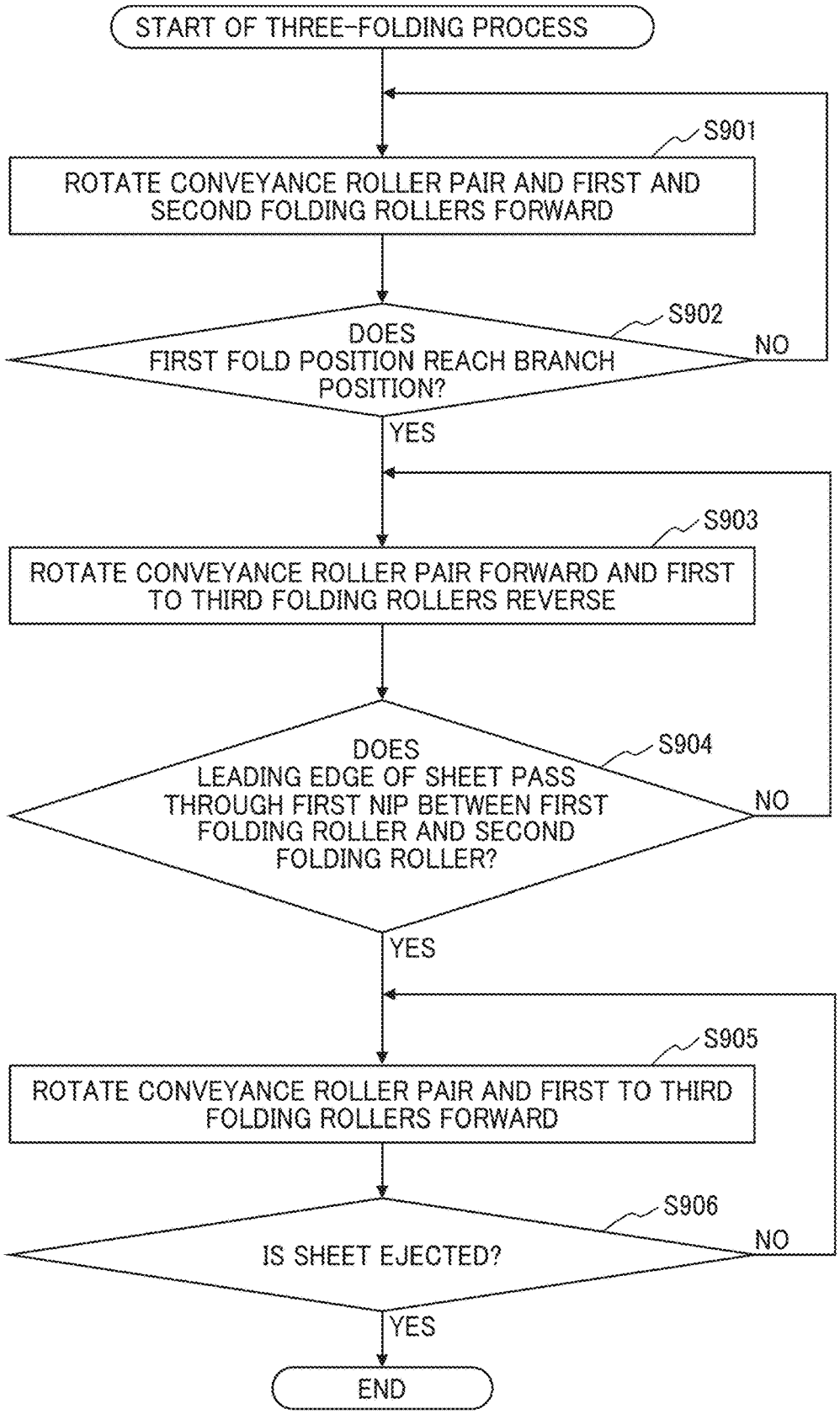
FIG. 9 is a flowchart of a three-folding process according to an embodiment of the present disclosure.
Figure 10:
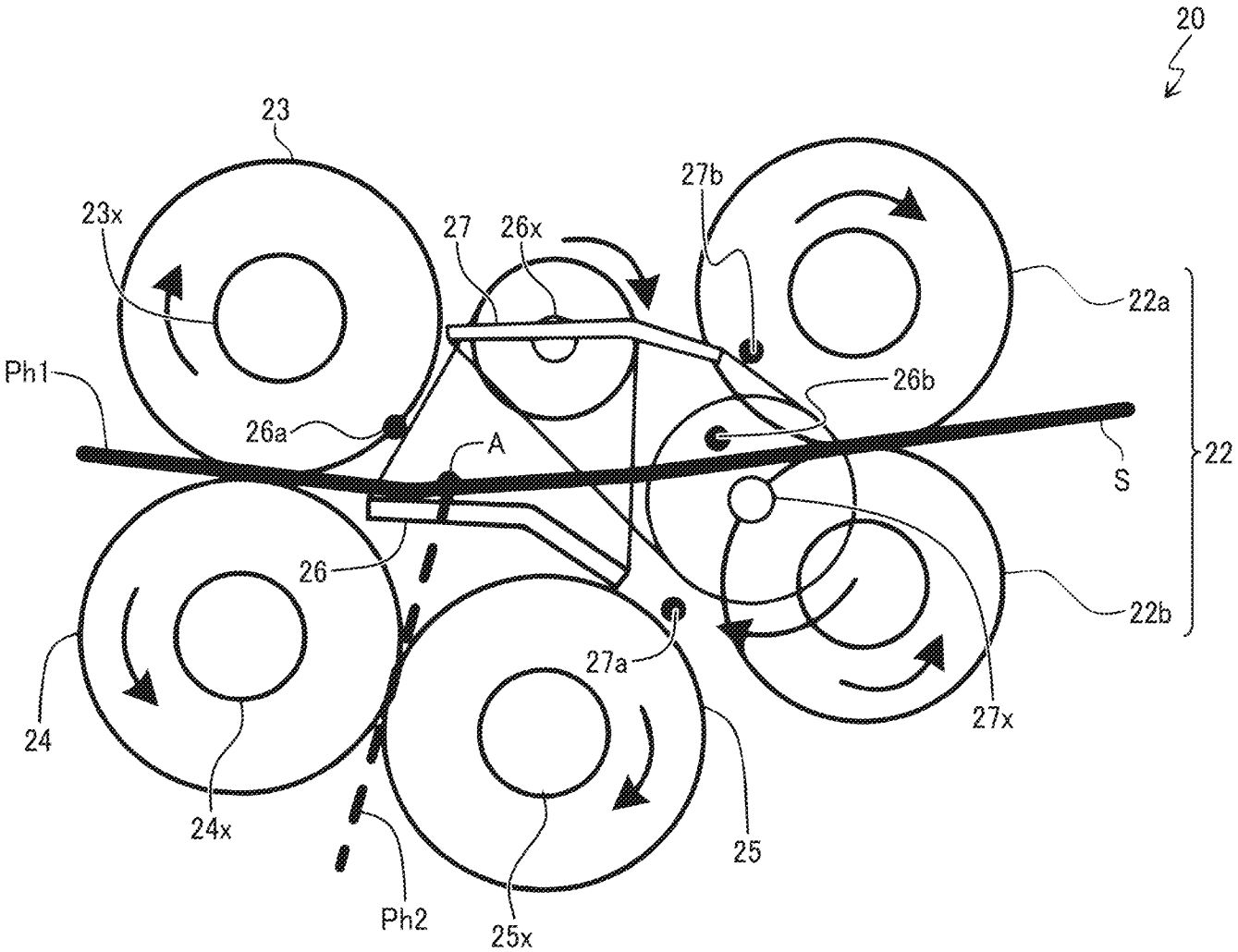
FIG. 10 is a diagram illustrating a sheet in a sheet folder when a first fold position of the sheet reaches a branch position, according to an embodiment of the present disclosure.
Figure 11:
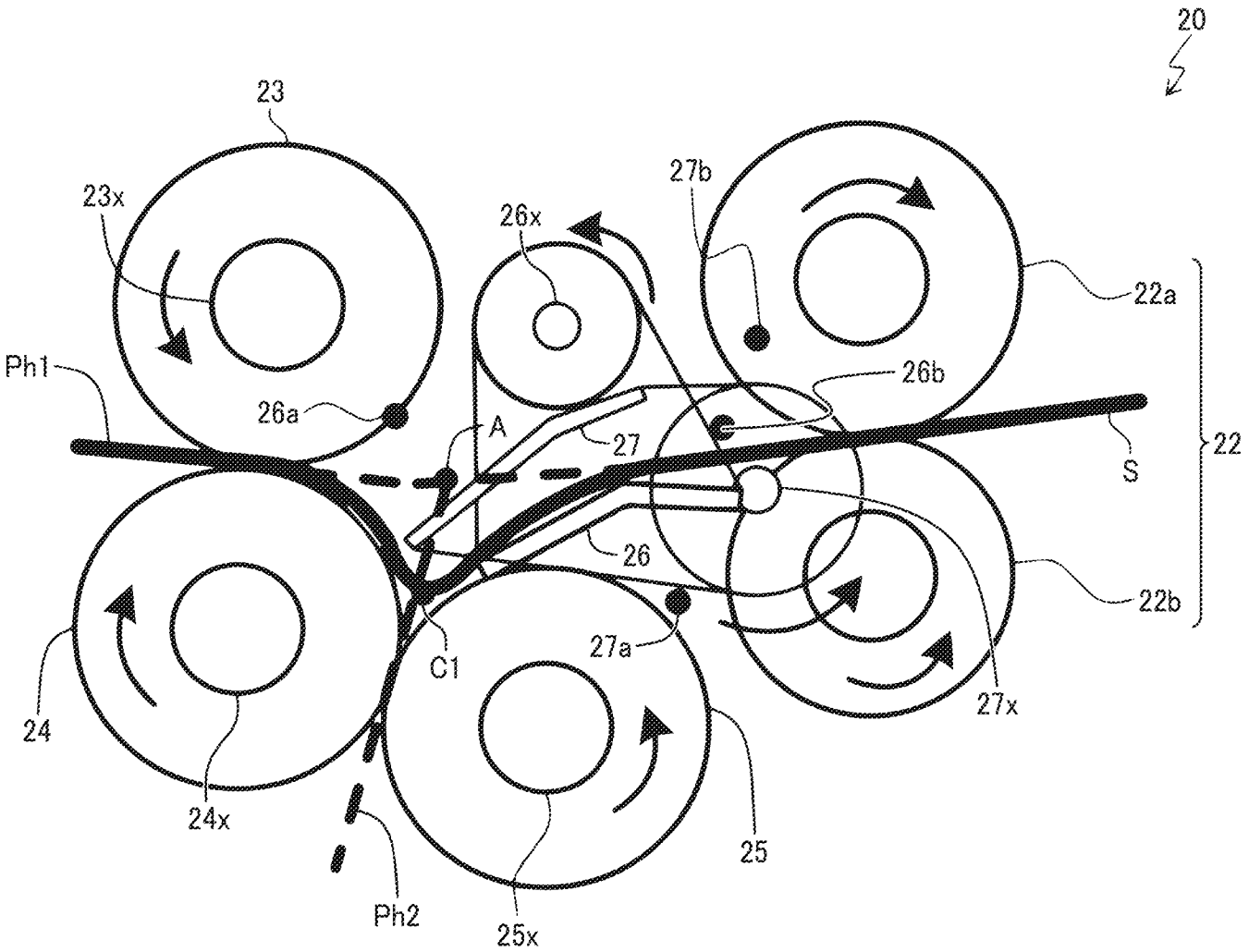
FIG. 11 is a diagram illustrating a sheet in a sheet folder immediately before the first fold position on the sheet is nipped by a second folding roller and a third folding roller, according to an embodiment of the present disclosure.
Figure 12:
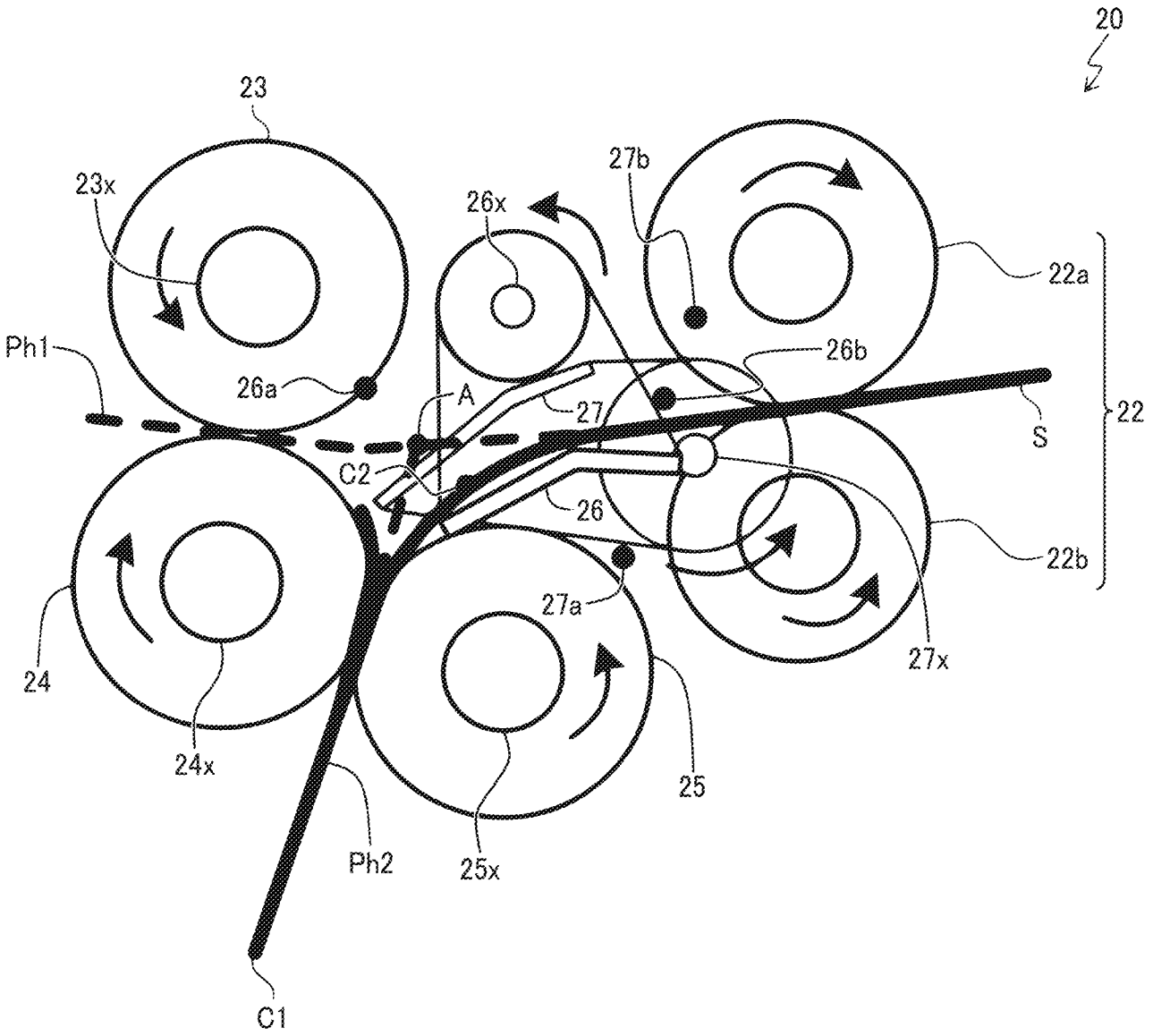
FIG. 12 is a diagram illustrating a sheet in a sheet folder when the leading edge of the sheet passes through a nip between a first folding roller and a second folding roller, according to an embodiment of the present disclosure.
Figure 13:
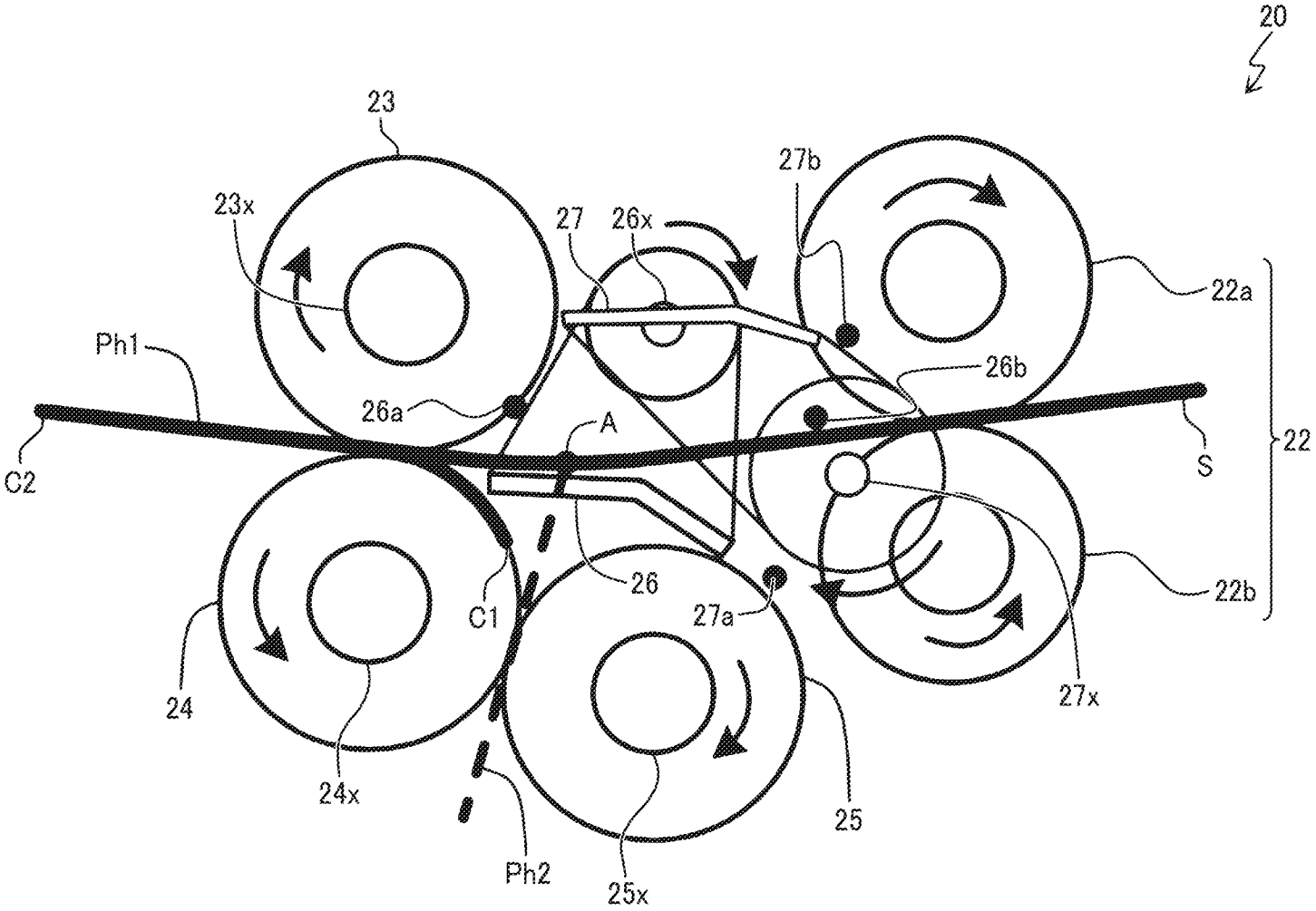
FIG. 13 is a diagram illustrating a sheet in a sheet folder after the sheet is folded at a second fold position, according to an embodiment of the present disclosure.

With reference to FIGS. 9 to 13, a three-folding process that folds the sheet S by the Z-fold or the letter fold-out is described below. FIG. 9 is a flowchart of the three-folding process according to the present embodiment. FIG. 10 is a diagram illustrating the sheet S in the sheet folder 20 when the first fold position C1 of the sheet S reaches the branch position A, according to the present embodiment. FIG. 11 is a diagram illustrating the sheet S in the sheet folder 20 immediately before a part of the sheet at the first fold position C1 is nipped by the second folding roller 24 and the third folding roller 25, according to the present embodiment. FIG. 12 is a diagram illustrating the sheet S in the sheet folder 20 when the leading edge of the sheet S passes through the first nip between the first folding roller 23 and the second folding roller 24, according to the present embodiment. FIG. 13 is a diagram illustrating the sheet S in the sheet folder 20 after the sheet S is folded at the second fold position C2, according to the present embodiment.

The controller 100 starts the three-folding process illustrated in FIG. 9 in response to supplying the sheet S from the image forming section 12 to the input interface IN. How to fold the sheet S (in other words, the first fold position C1 and the second fold position C2 on the sheet S in the conveyance direction) may be instructed by input to the operation panel 110 or a command transmitted from an external apparatus through a communication network. The controller 100 controls the sheet folder 20 to shift the first fold position C1 and the second fold position C2 in the conveyance direction. As a result, the sheet folder 20 can perform both the Z-fold illustrated in FIG. 8A and the letter fold-out illustrated in FIG. 8B.

When the controller 100 starts the three-folding process, the controller 100 firstly controls the second folding motor 24*a* to rotate the conveyance roller pair 22, the first folding roller 23, and the second folding roller 24 in the forward direction in step S901. In addition, the second folding motor 24*a* moves the first guide plate 26 to arrange the first guide plate 26 in the first guide posture and moves the second guide plate 27 to arrange the second guide plate 27 in the second retracted posture. In other words, controller 100 controls the conveyance roller pair 22, the first folding roller 23, and the second folding roller 24 to rotate in the forward direction, controls the first guide plate 26 to be arranged in the first guide posture, and controls the second guide plate 27 to be arranged in the second retracted posture as illustrated in FIG. 10. The conveyance roller pair 22 conveys the sheet S supplied through the input interface IN in the conveyance direction, the first guide plate 26 in the first guide posture guides the sheet S to the first nip between the first folding roller 23 and the second folding roller 24. The controller 100 continues the processing of step S901 until the first fold position C1 on the sheet S reaches the branch position A (NO in step S902).

When the first fold position C1 reaches the branch position A (YES in step S902), the controller 100 controls the conveyance roller pair 22 to rotate the conveyance roller pair 22 in the forward direction and controls the first folding roller 23, the second folding roller 24, and the third folding roller 25 to rotate the first folding roller 23, the second folding roller 24, and the third folding roller 25 in the reverse direction in step S903. Rotating the first folding roller 23, the second folding roller 24 and the third folding roller 25 in the reverse direction changes the posture of the first guide plate 26 to the first retracted posture and the posture of the second guide plate 27 to the second guide posture as illustrated in FIG. 11. In other words, the controller 100 controls the first guide plate 26 to be arranged in the first retracted posture and controls the second guide plate 27 to be arranged in the second guide posture. The sheet S has one portion nipped by the conveyance roller pair 22 rotating in the forward direction and the other portion nipped by the first folding roller 23 and the second folding roller 24 rotating in the reverse direction. The second guide plate 27 in the second guide posture guides the sheet S to the branch conveyance path Ph2. In the branch conveyance path Ph2, the sheet S is nipped by the second folding roller 24 and the third folding roller 25. At this time, the first fold position C1 on the sheet S firstly arrives at the second nip between the second folding roller 24 and the third folding roller 25. As a result, the sheet S is folded at the first fold position C1 to form a first fold portion in the sheet S. Subsequently, the controller 100 continues the processing of step S903 until the leading edge of the sheet S passes through the first nip between the first folding roller 23 and the second folding roller 24 as illustrated in FIG. 12 (NO in step S904).

In response to the leading edge of the sheet S passing through the first nip between the first folding roller 23 and the second folding roller 24 (YES in step S904), the controller 100 controls the conveyance roller pair 22, the first folding roller 23, and the second folding roller 24 to rotate in the forward direction in step S905. Rotating the conveyance roller pair 22, the first folding roller 23, and the second folding roller 24 in the forward direction changes the posture of the first guide plate 26 to the first guide posture and the posture of the second guide plate 27 to the second retracted posture as illustrated in FIG. 13. In other words, the controller 100 control the first guide plate 26 to be arranged in the first guide posture and controls the second guide plate 27 to be arranged in the second retracted posture. The sheet S has one portion nipped by the conveyance roller pair 22 and the other portion nipped by the second folding roller 24 and the third folding roller 25. A leading edge of the sheet S is overlaid on a point of the sheet at the second fold position C2 to be the leading edge of movement of the sheet S. In other words, a portion of the sheet different from the first fold portion at the second fold position is conveyed to the first nip to form a second fold portion in the sheet. The first guide plate 26 in the first guide posture guides the sheet S to the first nip between the first folding roller 23 and the second folding roller 14. As a result, the sheet S is folded at the second fold position C2, and the Z-fold is completed.

Subsequently, the controller 100 continues the processing of step S905 until a trailing end of the sheet S passes through the first nip between the first folding roller 23 and the second folding roller 24 in the conveyance direction (NO in step S906), that is, until the ejection of the sheet subjected to the three-folding process is completed. When the trailing end of the sheet S passes through the first nip between the first folding roller 23 and the second folding roller 24 in the conveyance direction (YES in step S906), the controller 100 stops rotating the conveyance roller pair 22, the first folding roller 23, and the second folding roller 24 to complete the three-folding process.

Figure 14:
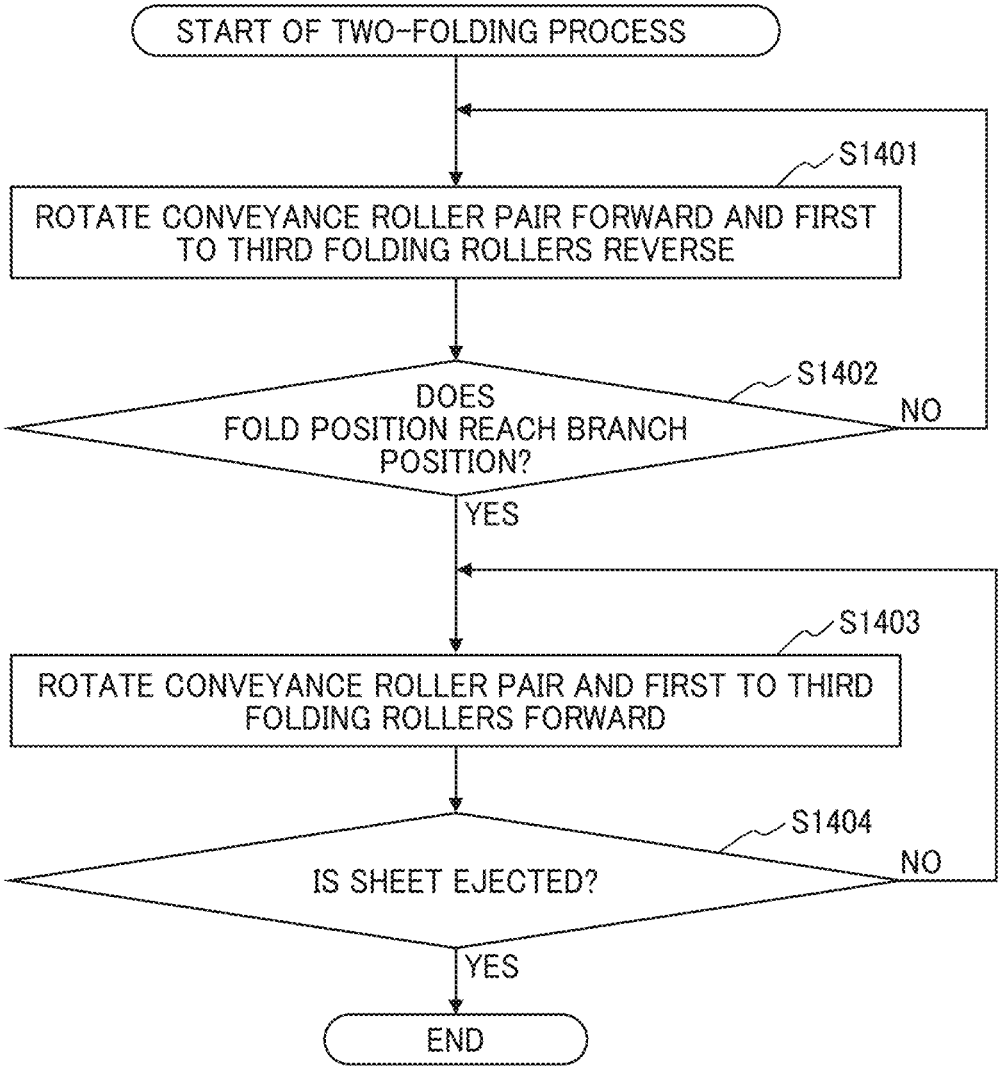
FIG. 14 is a flowchart of a two-folding process according to an embodiment of the present disclosure.
Figure 15:
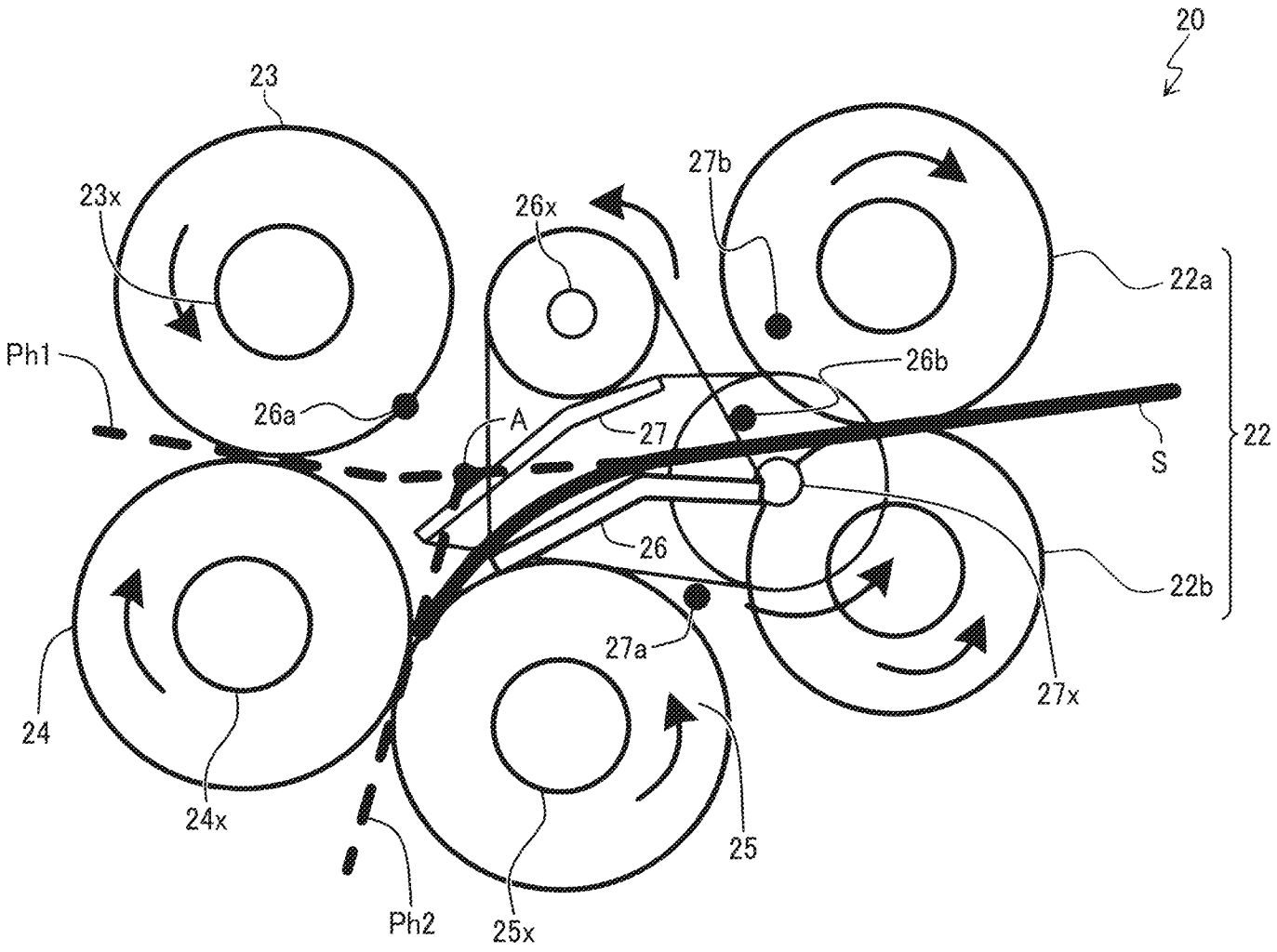
FIG. 15 is a diagram illustrating a sheet in a sheet folder when the leading edge of the sheet enters a branch conveyance path, according to an embodiment of the present disclosure.
Figure 16:
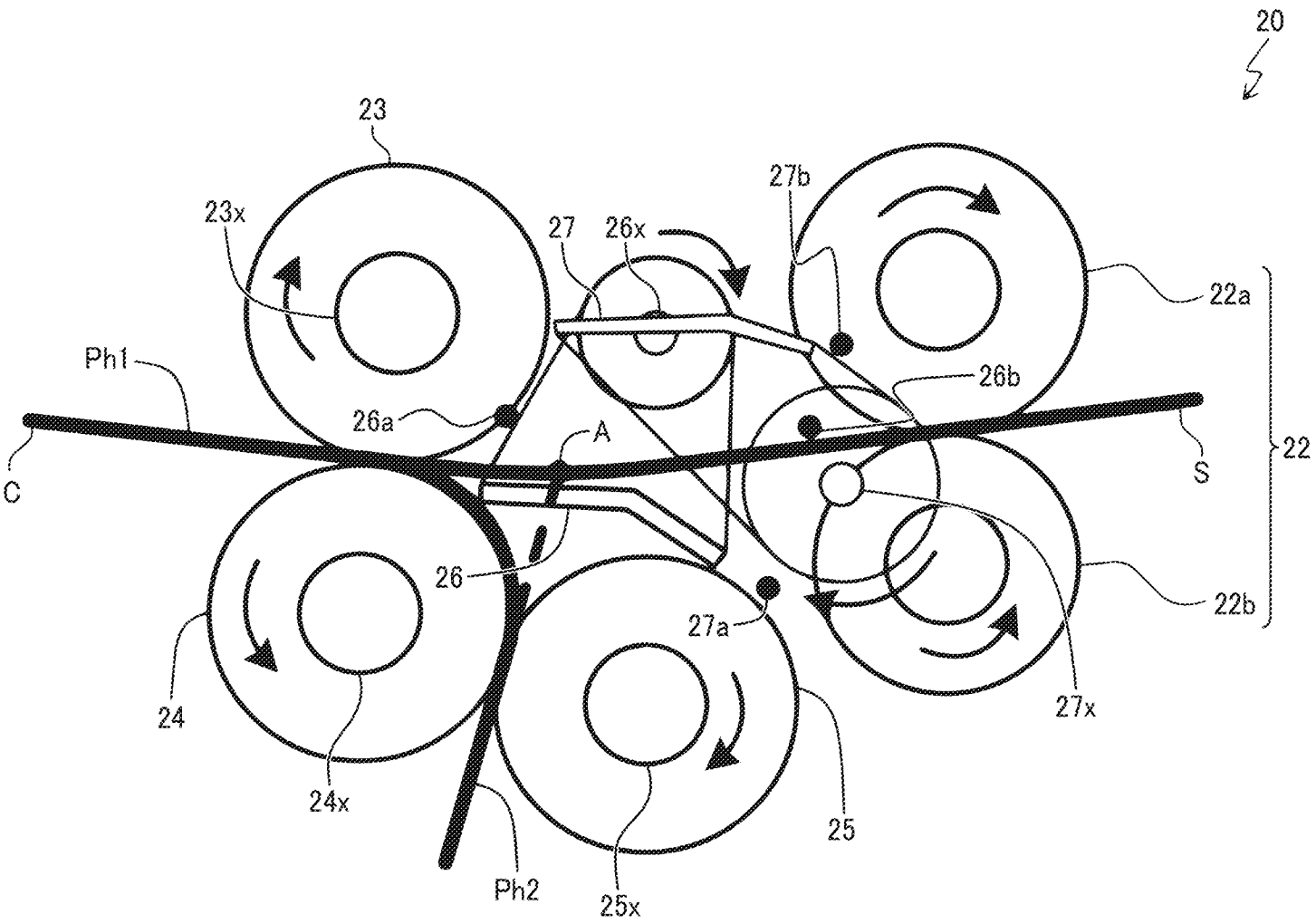
FIG. 16 is a diagram illustrating a sheet in a sheet folder after the sheet is folded at a fold position, according to an embodiment of the present disclosure.

With reference to FIGS. 14 to 16, two-folding process that folds the sheet S by the half-fold is described below.

FIG. 14 is a flowchart of the two-folding process according to the present embodiment. FIG. 15 is a diagram illustrating the sheet S in the sheet folder 20 when the leading edge of the sheet S enters the branch conveyance path Ph2, according to the present embodiment. FIG. 16 is a diagram illustrating the sheet S in the sheet folder 20 after the sheet S is folded at a fold position C, according to the present embodiment. The detailed description of the two-folding process common to the three-folding process is omitted and the description of the two-folding process different from the three-folding process is given.

When the controller 100 starts the two-folding process, the controller 100 firstly controls the conveyance roller pair 22 to rotate in the forward direction and controls the first folding roller 23, the second folding roller 24, and the third folding roller 25 to rotate in the reverse direction in step S1401. Rotating the first folding roller 23, the second folding roller 24 and the third folding roller 25 in the reverse direction changes the posture of the first guide plate 26 to the first retracted posture and the posture of the second guide plate 27 to the second guide posture as illustrated in FIG. 15. In other words, the controller 100 controls the first guide plate 26 to be arranged in the first retracted posture and controls the second guide plate 27 to be arranged in the second guide posture. The conveyance roller pair 22 conveys the sheet S in the conveyance direction, the second guide plate 27 in the second guide posture guides the leading edge of the sheet S to the branch conveyance path Ph2, and the second folding roller 24 and the third folding roller 25 nip the sheet S. The controller 100 continues the processing of step S1401 until a part of the sheet at the fold position C reaches the branch position A (NO in step S1402).

When the part of the sheet S at the fold position C reaches the branch position A (YES in step S1402), the controller 100 controls the conveyance roller pair 22, the first folding roller 23, the second folding roller 24, and the third folding roller 25 to rotate in the forward direction in step S1403. Rotating the conveyance roller pair 22, the first folding roller 23, the second folding roller 24, and the third folding roller 25 in the forward direction changes the posture of the first guide plate 26 to the first guide posture and the posture of the second guide plate 27 to the second retracted posture as illustrated in FIG. 16. In other words, the controller controls the first guide plate 26 to be arranged in the first guide posture and controls the second guide plate 27 to be arranged in the second retracted posture, The sheet S has one portion nipped by the conveyance roller pair 22 and the other portion nipped by the second folding roller 24 and the third folding roller 25. Rotating these rollers in the forward direction moves the fold point C as the leading edge of movement of the sheet S. The first guide plate 26 in the first guide posture guides the sheet S to the first nip between the first folding roller 23 and the second folding roller 24. In other words, a portion of the sheet different from the leading edge of the sheet is conveyed to the first nip to form a fold portion in the sheet. Subsequently, the controller 100 continues the processing of step S1403 until the trailing end of the sheet S passes through the first nip between the first folding roller 23 and the second folding roller 24 in the conveyance direction (NO in step S1404), that is, until the ejection of the sheet subjected to the two-folding process is completed. When the trailing end of the sheet S passes through the first nip between the first folding roller 23 and the second folding roller 24 in the conveyance direction (YES in step S1404), the controller 100 stops rotating the conveyance roller pair 22, the first folding roller 23, and the second folding roller 24 to complete the two-folding process.

The controller 100 does not need to execute the three-folding process or the two-folding process on all the sheets S on which the images are formed by the image forming section 12. When the sheet folder does not fold the sheet S, the sheet S passes through the sheet folder 20 and is ejected from the sheet folder 20. The controller 100 rotates the conveyance roller pair 22, the first folding roller 23, and the second folding roller 24 in the forward direction until the trailing edge of the sheet S passes through the first nip between the first folding roller 23 and the second folding roller 24 in the conveyance direction in response to the sheet S being supplied from the image forming section 12 to the input interface IN.

The control of the controller 100 when the sheet folder 20 folds the sheet S on which the image is formed by the image forming section 12 and delivers the sheet S to the sheet binder 30 is referred to as a first control in the present embodiment. On the other hand, the control of the controller 100 when the sheet folder 20 does not fold the sheet S on which the image is formed by the image forming section 12 and delivers the sheet S to the sheet binder 30 is referred to as a second control in the present embodiment. The controller 100 may be configured to switch between the first control and the second control based on an instruction instructed by input to the operation panel 110 or a command transmitted from an external apparatus through a communication network.

Figure 17A:
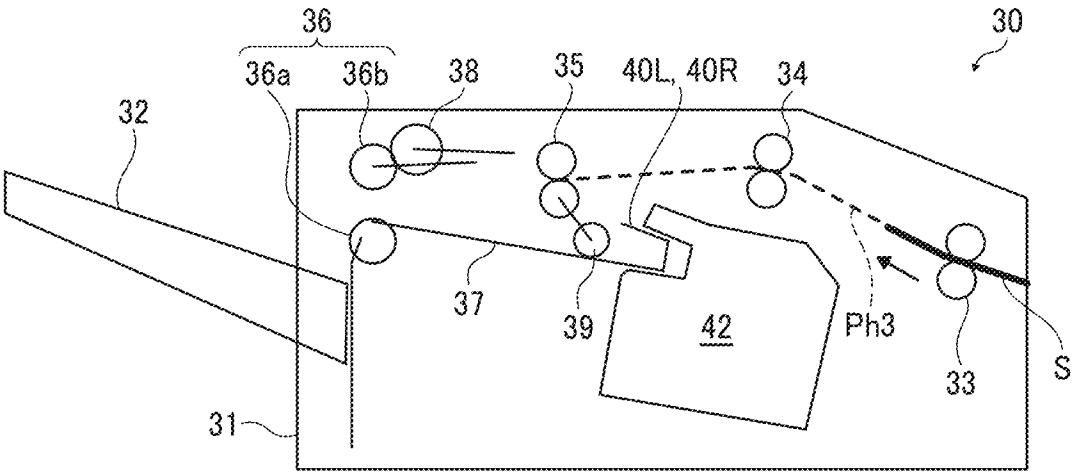
FIG. 17A is a diagram illustrating a sheet binder that receives a sheet, according to an embodiment of the present disclosure.
Figure 18A:
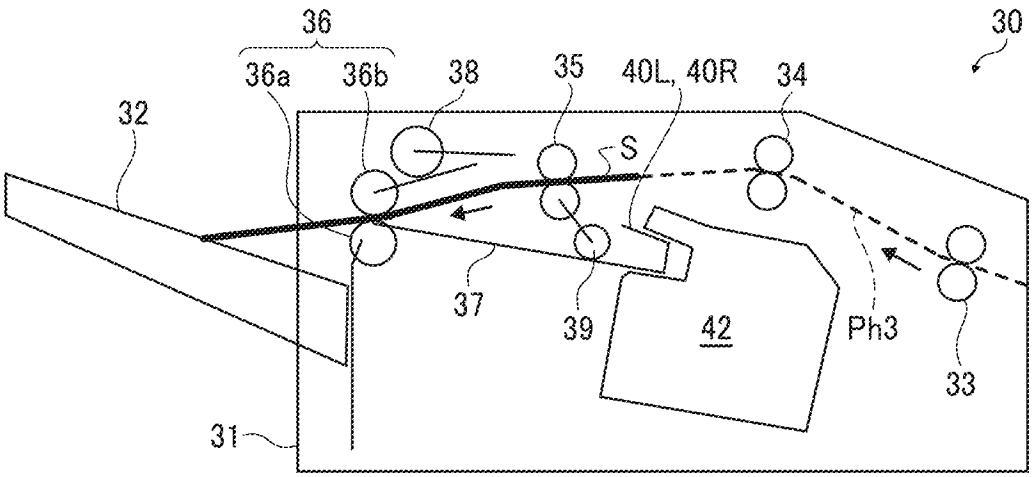
FIGS. 18A and 18B are diagrams illustrating a sheet binder that does not perform a binding process and ejects a sheet to an output tray, according to an embodiment of the present disclosure.
Figure 18B:
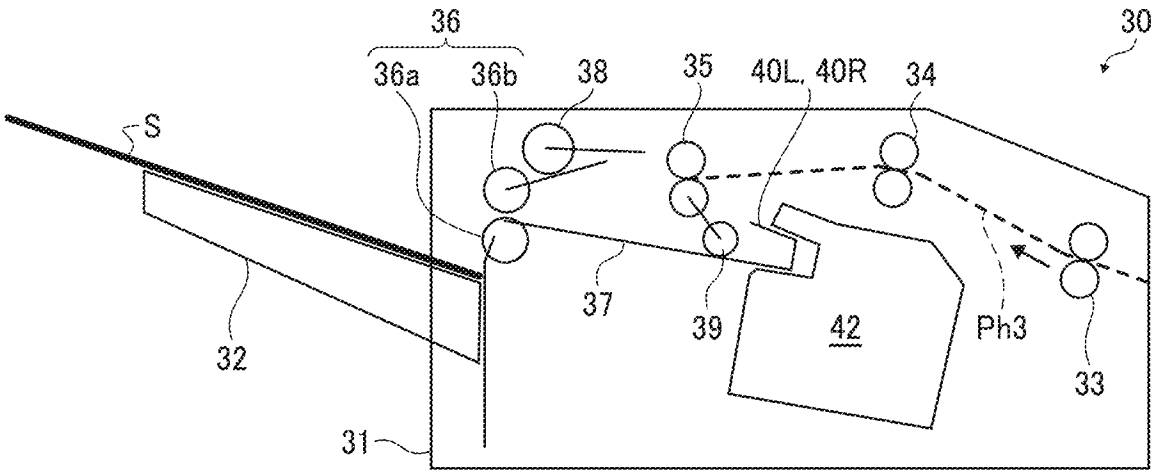
Figure 19A:
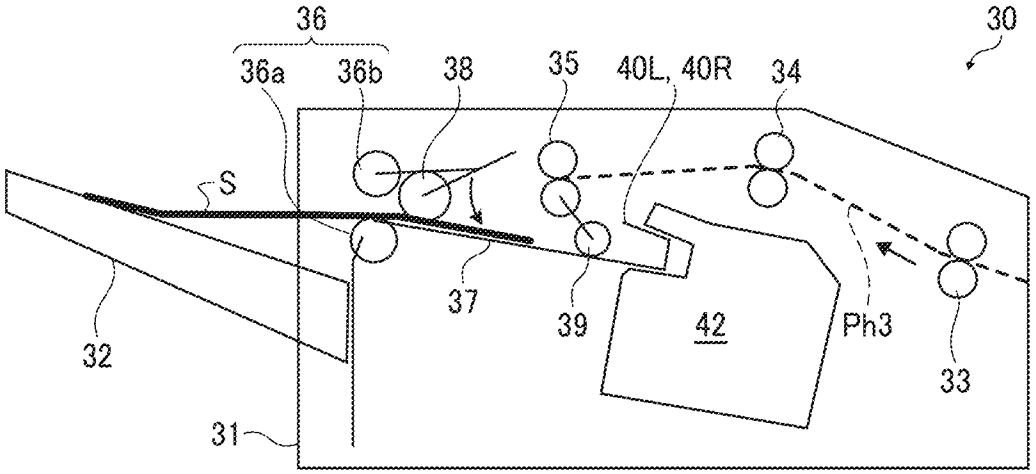
FIGS. 19A and 19B are diagrams illustrating a sheet binder that performs a binding process, according to an embodiment of the present disclosure.
Figure 19B:
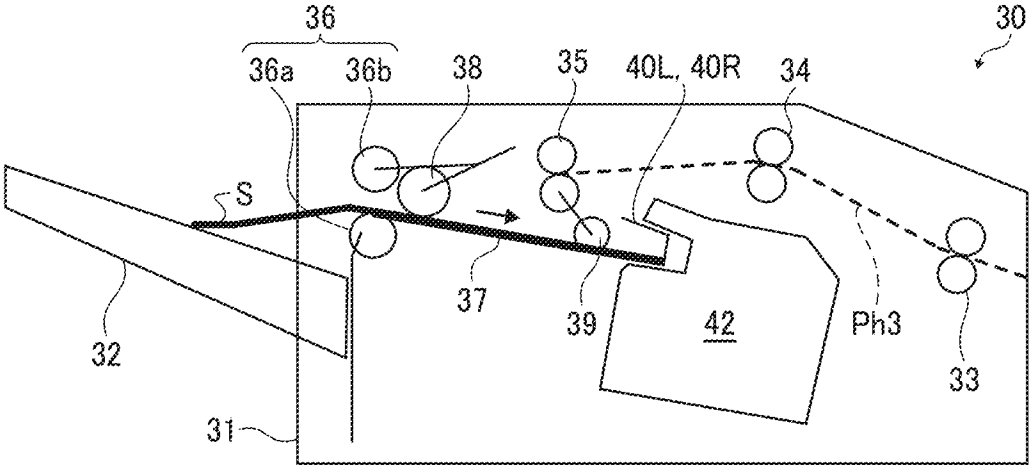
Figure 20:
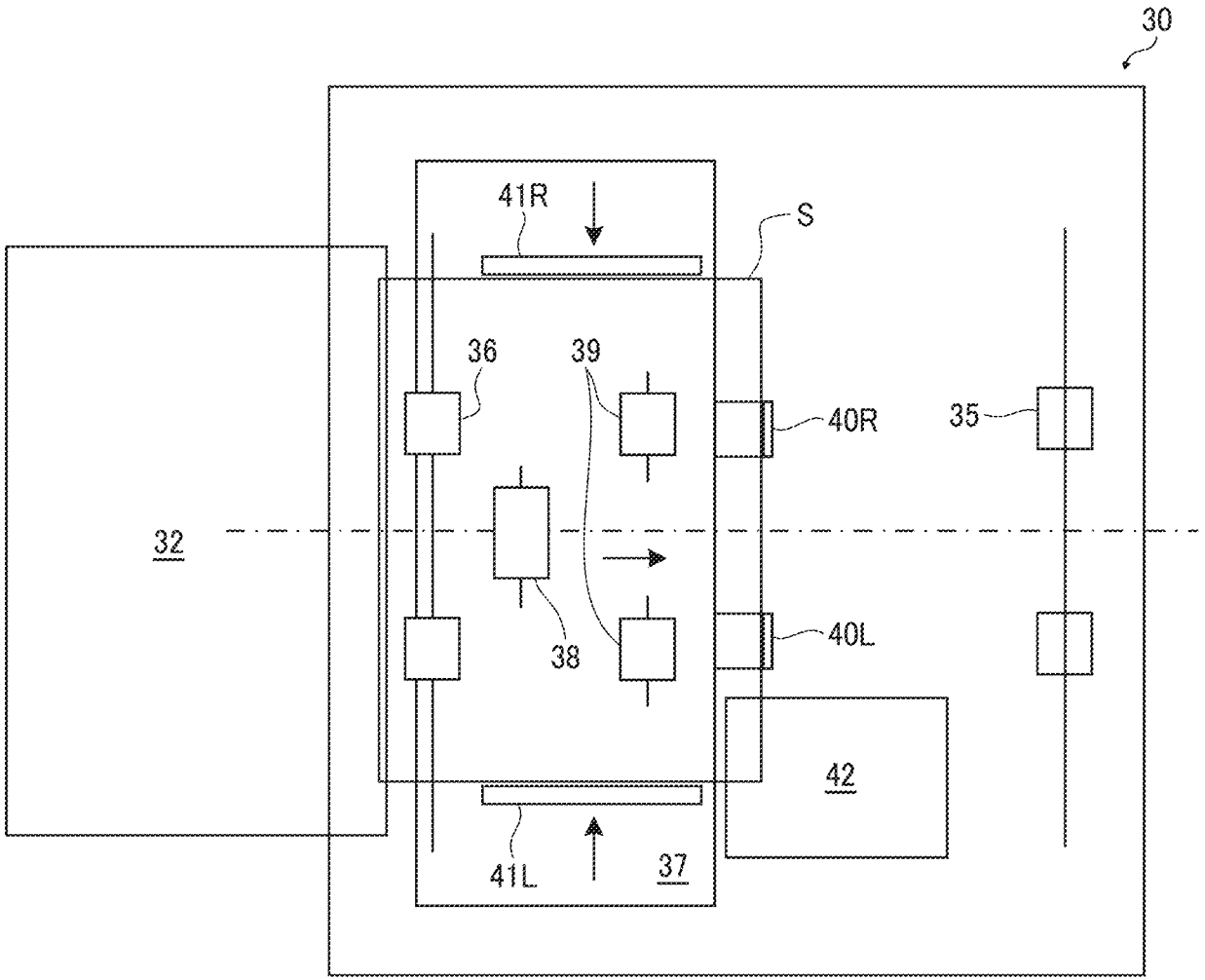
FIG. 20 is a diagram illustrating the sheet binder of FIG. 19B as viewed from a thickness direction of the sheet.
Figure 21A:
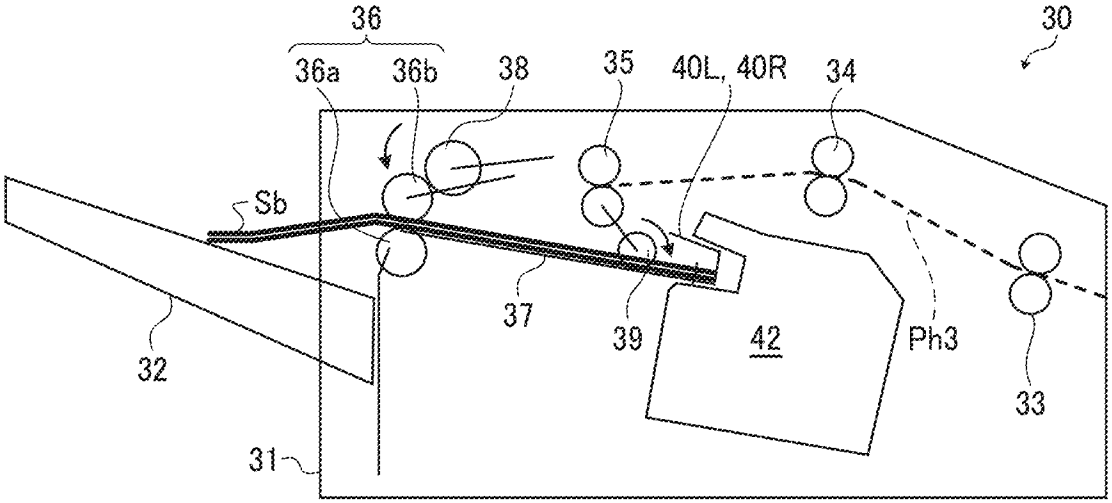
FIGS. 21A and 21B are diagrams illustrating a sheet binder when a sheet bundle subjected to a binding process is ejected to an output tray, according to an embodiment of the present disclosure.
Figure 21B:
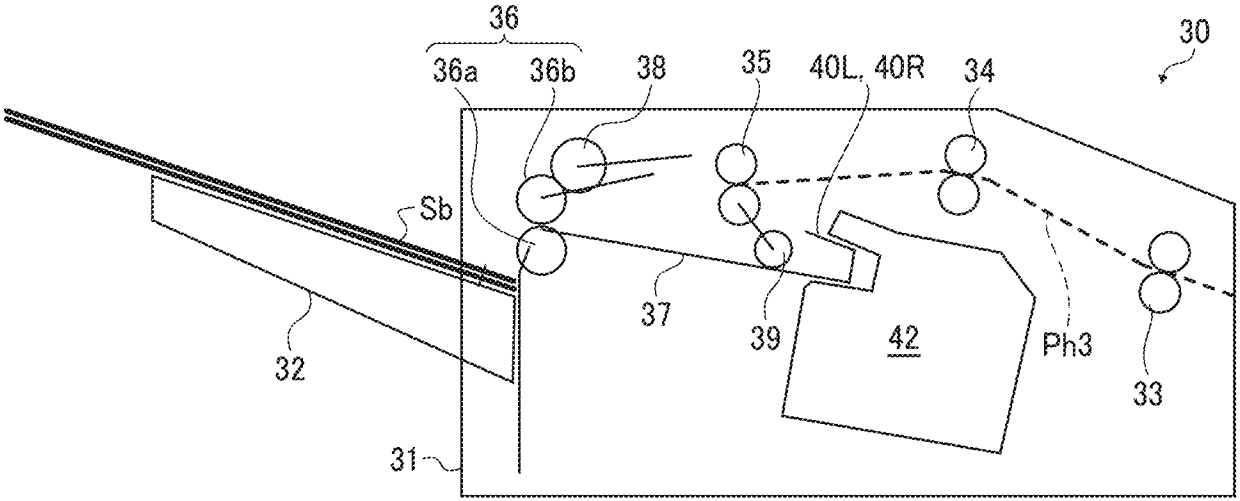

With reference to FIGS. 17A to 21B, the following describes the operations of the sheet binder 30. FIG. 17A is a diagram illustrating the sheet binder 30 that receives the sheet S, and FIG. 17B is a diagram illustrating the sheet binder in which the sheet S reaches the conveyance roller pair 36, according to the present embodiment. FIGS. 18A and 18B are diagrams illustrating the sheet binder 30 that does not perform the binding process and ejects the sheet S to the output tray 32, according to the present embodiment. FIGS. 19A and 19B are diagrams illustrating the sheet binder 30 that performs the binding process, according to the present embodiment. FIG. 20 is a diagram illustrating the sheet binder 30 of FIG. 19B as viewed from a thickness direction of the sheet S, according to the present embodiment. FIGS. 21A and 21B are diagrams illustrating the sheet binder 30 when the sheet bundle Sb subjected to the binding process is ejected to the output tray 32, according to the present embodiment.

Figure 17B:
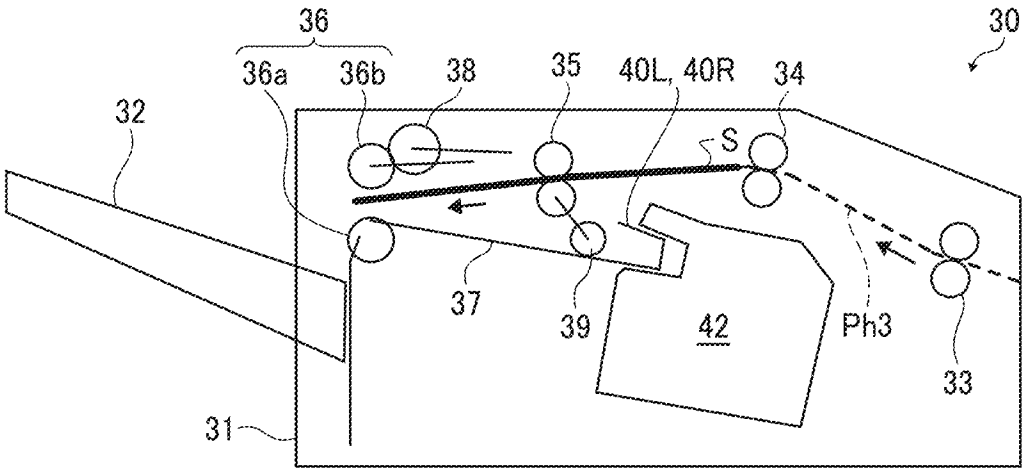
FIG. 17B is a diagram illustrating a sheet binder in which a sheet reaches a conveyance roller pair, according to an embodiment of the present disclosure.

When the sheet binder 30 starts the binding process, firstly rotating the conveyance roller pairs 33 to 35 in forward directions conveys the sheet S supplied from the sheet bender 20 in the conveyance direction along the conveyance path Ph3 as illustrated in FIGS. 17A and 17B. At this time, in the conveyance roller pair 36, the driving roller 36*a* and the driven roller 36*b* are separated from each other.

When the sheet binder 30 does not perform the binding process on the sheet S, the driving roller 36*a* and the driven roller 36*b* nip the sheet S as illustrated in FIG. 18A. Subsequently, rotating the conveyance roller pair 36 in the forward direction ejects the sheet S to the output tray 32 as illustrated in FIG. 18B.

When the sheet binder 30 performs the binding process on the sheet S, the tapping roller 38 and the return roller 39 abut on the sheet S after passing through the conveyance roller pair 35 and rotate to accommodate the sheet S in the internal tray 37 as illustrated in FIGS. 19A and 19B. In the sheet binder 30, moving the side fences 41L and 41R in the width direction as illustrated in FIG. 20 aligns the positions of the sheets S accommodated in the internal tray 37 in the width direction.

Repeating the processing illustrated in FIGS. 17A, 17B, 19A, 19B, and 20 in the sheet binder 30 forms the sheet bundle Sb on the internal tray 37.

Subsequently, driving the binder 42 in the sheet binder 30 binds the sheet bundle Sb supported by the internal tray 37. After the binder 42 binds the sheet bundle Sb, the driving roller 36*a* and the driven roller 36*b* in the sheet binder 30 nip the sheet bundle Sb as illustrated in FIG. 21A. Rotating the conveyance roller pair 36 and the return roller 39 in the forward direction in the sheet binder 30 ejects the sheet bundle Sb to the output tray 32 as illustrated in FIG. 21B.

According to the above-described embodiments of the present disclosure, for example, the following operational effects can be obtained.

According to the above-described embodiments of the present disclosure, various kinds of folding methods can be performed by combining the forward rotation and the reverse rotation of the three folding rollers 23, 24, and 25. Switching the postures of the first guide plate 26 and the second guide plate 27 enables appropriately conveying the sheet S in a desired direction. Since the driving-force transmission 28 rotates the second folding roller 24, the first guide plate 26, and the second guide plate 27 in conjunction with each other, a driving source for rotating the first guide plate 26 and the second guide plate 27 can be omitted. As a result, the above-described configuration enables manufacturing the sheet folder 20 that can perform various kinds of folding methods with a relatively simple configuration.

According to the above-described embodiments of the present disclosure, designing the first distance D1 and the second distance D2 to be different from each other generates a difference between the rotation speed of the guide plate 26 and the rotation speed of the guide plate 27. The above-described configuration enables adjusting the speed at which the distance between the distal ends of the guide plates 26 and 27 increases (and decreases) when the guide plates 26 and 27 change their postures in conjunction with each other. In particular, designing the second distance D2 to be longer than the first distance D1 increases the speed at which the distance between the distal ends of the guide plates 26 and 27 increases when the sheet S is guided to the first nip between the first folding roller 23 and the second folding roller 24, which increases the margin for the bending of the sheet S.

According to the above-described embodiments of the present disclosure, designing the first rotation angle θ1 and the second rotation angle θ2 to be different from each other can change the distance between the distal ends of the guide plates 26 and 27 to guide the sheet S to the first nip between the first folding roller 23 and the second folding roller 24 as illustrated in FIG. 4A to be different from the distance between the distal ends of the guide plates 26 and 27 to guide the sheet S to the second nip between the second folding roller 24 and the third folding roller 25 as illustrated in FIG. 4B. In particular, designing the second rotation angle θ2 to be larger than the first rotation angle θ1 increases the speed at which the distance between the distal ends of the guide plates 26 and 27 increases when the sheet S is guided to the first nip between the first folding roller 23 and the second folding roller 24, which increases the margin for the bending of the sheet S.

According to the above-described embodiments of the present disclosure, designing the ratio of the transmission ratios R1 and R2 to be equal to the ratio of the rotation angles θ1 and θ2 ($R2/R1=\theta2/\theta1$) matches the timing at which the first guide plate 26 reaches the first guide position and the timing at which the second guide plate 27 reaches the second retracted position and matches the timings at which the first guide plate 26 reaches the first retracted position and the timing at which the second guide plate 27 reaches the second guide position. As a result, the spatial margin between the distal ends of the guide plates 26 and 27 can be balanced in the cases illustrated in FIGS. 4A and 4B.

According to the above-described embodiments of the present disclosure, designing the ratio of the transmission ratios R1 and R2 to be different from the ratio of the rotation angles θ1 and θ2 ($R2/R1\neq\theta2/\theta1$) can change the spatial margin between the distal ends of the guide plates 26 and 27 to guide the sheet S to the first nip between the first folding roller 23 and the second folding roller 24 as illustrated in FIG. 4A to be different from the spatial margin between the distal ends of the guide plates 26 and 27 to guide the sheet S to the second nip between the second folding roller 24 and the third folding roller 25 as illustrated in FIG. 4B.

For example, designing to be R2/R1>θ2/θ1 increases the spatial margin between the distal ends of the guide plates 26 and 27 to guide the sheet S to the first nip between the first folding roller 23 and the second folding roller 24 as illustrated in FIG. 4A to be larger than the spatial margin between the distal ends of the guide plates 26 and 27 to guide the sheet S to the second nip between the second folding roller 24 and the third folding roller 25 as illustrated in FIG. 4B.

In contrast, designing to be R2/R1<θ2/θ1 increases the spatial margin between the distal ends of the guide plates 26 and 27 to guide the sheet S to the second nip between the second folding roller 24 and the third folding roller 25 as illustrated in FIG. 4B to be larger than the spatial margin between the distal ends of the guide plates 26 and 27 to guide the sheet S to the first nip between the first folding roller 23 and the second folding roller 25 as illustrated in FIG. 4A.

According to the above-described embodiments of the present disclosure, designing the rotational speeds of the guide plates 26 and 27 to be faster than the rotational speed of the second folding roller 24 can quickly change postures of the guide plates 26 and 27. This prevents unintended behavior such as bending of the sheet S and enhances the stability and accuracy of the folding process.

According to the above-described embodiments of the present disclosure, the stoppers 26*a*, 26*b*, 27*a*, and 27*b* to limit movable ranges of the guide plates 26 and 27 and the torque limiter gears 26*y* and 27*y* included in the driving-force transmission 28 form a simple configuration to rotate the second folding roller 24 and the guide plates 26 and 27 in conjunction with each other. The above-described configuration can further reduce the size of the sheet folder 20.

According to the above-described embodiments of the present disclosure, the driving-force transmission 28 is disposed on the opposite side of the partition 22*a* from the folding rollers 23 to 25 and the guide plates 26 and 27. As a result, the above-described configuration prevents the sheet S from being contaminated by dust from the driving-force transmission 28. In addition, the above-described configuration prevents the dust coming out of the sheet S from clogging the driving-force transmission 28 and enables the smooth transmission of the rotational driving force.

The sheet folder 20 according to the above-described embodiments of the present disclosure is particularly advantageous when the sheet folder 20 is mounted in the in-body space 13 of the image forming apparatus 10 having a limited space. However, the unit attached to the in-body space 13 is not limited to the sheet folder 20. The position of the sheet folder 20 is not limited to the in-body space 13.

A first modification of the above embodiments of the present disclosure is described below.

Figure 22A:
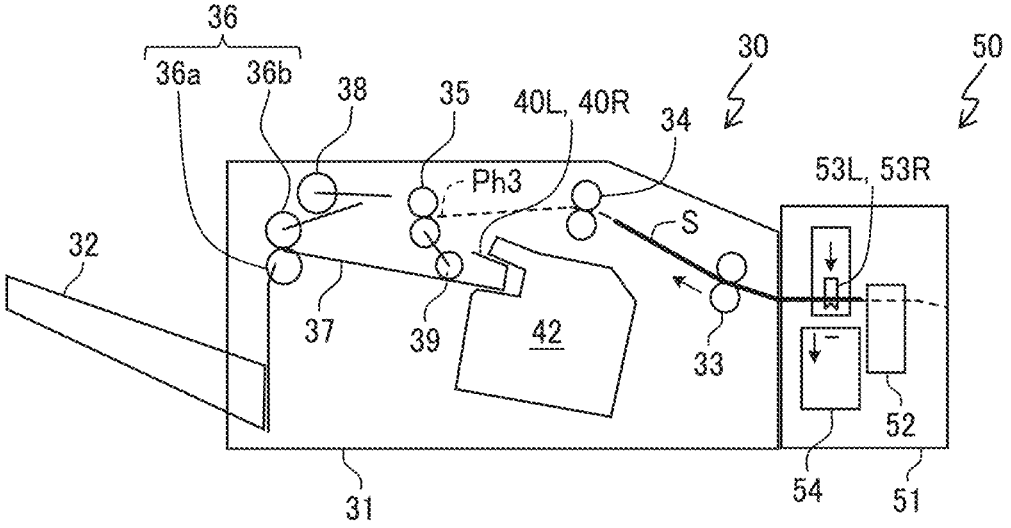
FIGS. 22A and 22B are diagrams illustrating an internal structure of a puncher according to an embodiment of the present disclosure.
Figure 22B:
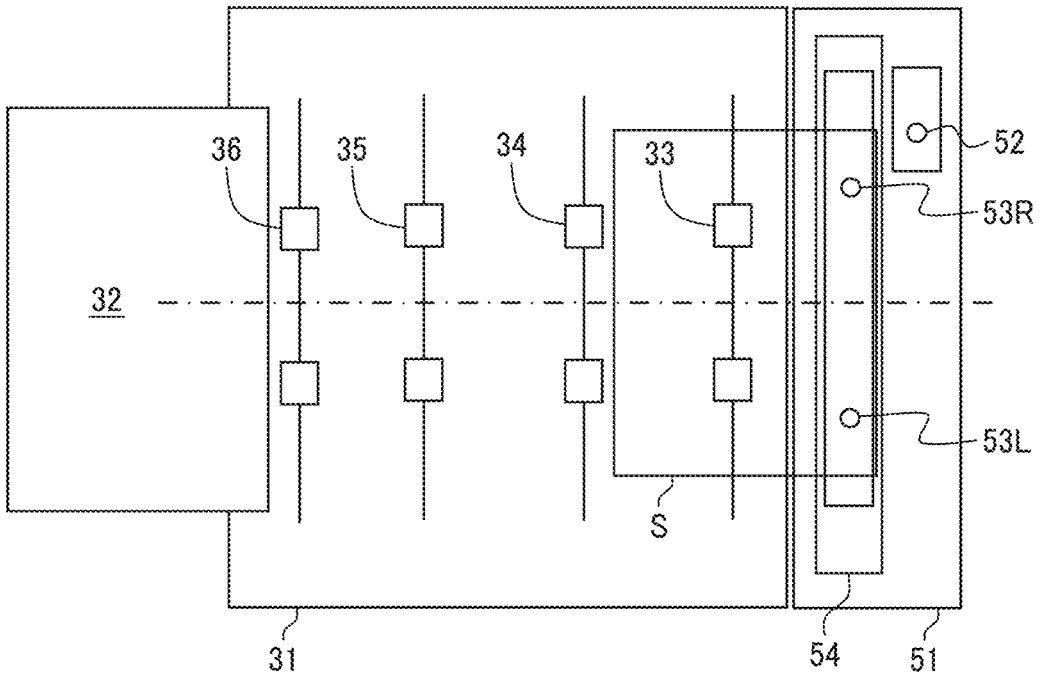

FIGS. 22A and 22B are diagrams illustrating an internal structure of the puncher 50 or a punch hole forming section, according to the first modification of the above embodiments of the present disclosure.

The puncher 50 illustrated in FIGS. 22A and 22B is configured to be attachable to and detachable from the position of the in-body space 13 from which the sheet folder 20 is detached. In other words, the image forming apparatus 10 is configured such that the sheet folder 20 and the puncher 50 can be replaced according to the use. The puncher 50 is configured, for example, as follows.

As illustrated in FIG. 22, the puncher 50 includes a housing 51, a sheet sensor 52, punch pins 53*a* and 53*b*, and a punch chad container 54. The housing 51 has an internal space for accommodating components of the puncher 50. In the internal space of the housing 51, a conveyance path is formed. The sheet on which the image is formed by the image forming section 12 passes through the conveyance path.

The sheet sensor 52 detects that the sheet S supplied from the image forming section 12 has reached a predetermined position. The punch pins 53*a* and 53*b* punch the sheet S detected by the sheet sensor 52. The punch chads that have fallen off from the sheet S fall into the punch chad container 54. The above-described puncher 50 performs the punching process for punching the sheet S.

A second modification of the above embodiments of the present disclosure is described below.

Figure 23:
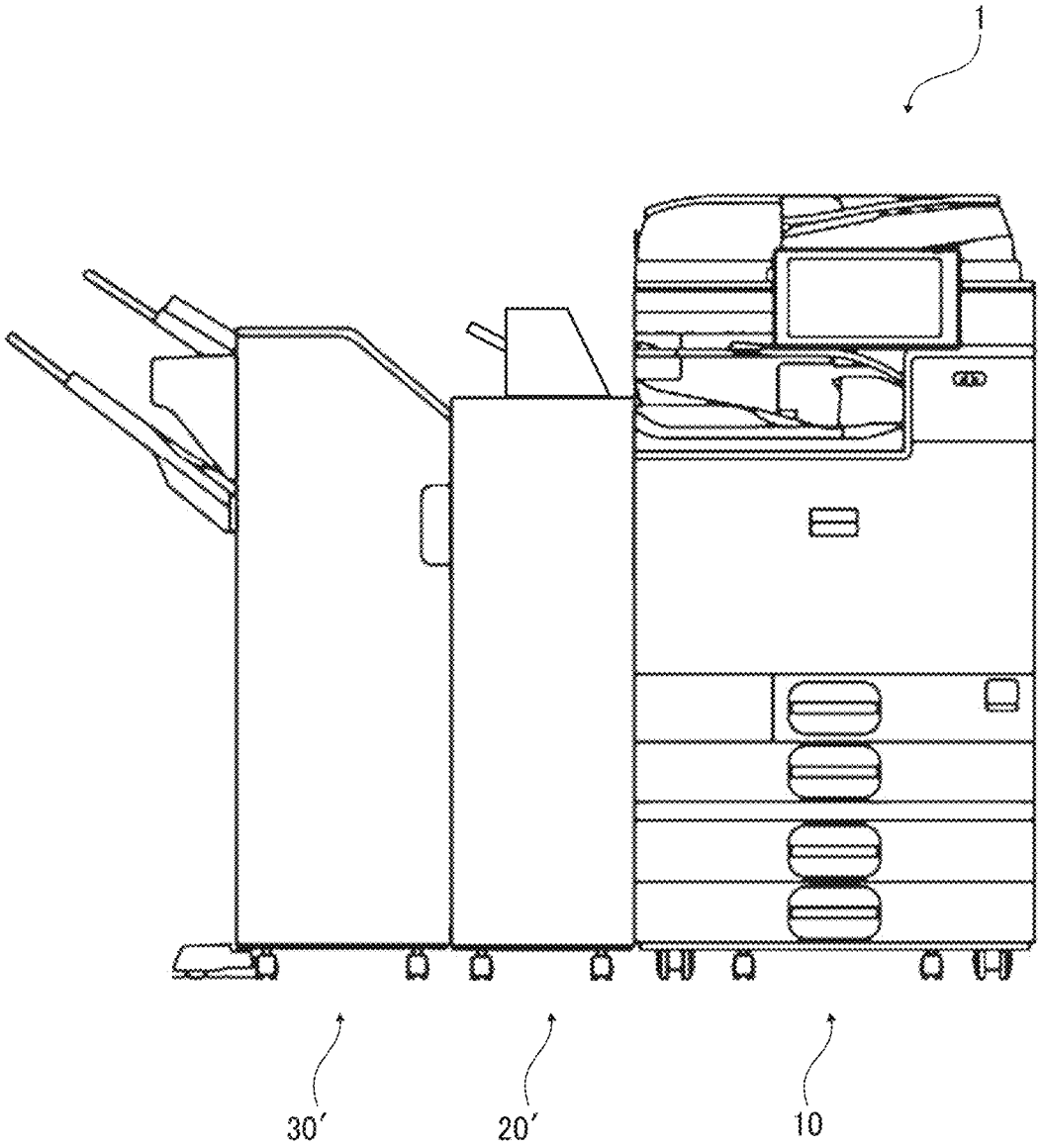
FIG. 23 is an external view of an image forming system according to an embodiment of the present disclosure.

FIG. 23 is an external view of an image forming system 1 according to the second modification of the above embodiments of the present disclosure. As illustrated in FIG. 23, the image forming system 1 includes the image forming apparatus 10, a sheet folder 20', and a sheet binder 30'. The image forming apparatus 10, the sheet folder 20', and the sheet binder 30' are apparatuses that can operate independently of each other and are configured to be connectable to each other. The sheet folder 20' has the same configuration as the sheet folder 20 described above, and the sheet binder 30' has the same configuration as the sheet binder 30 described above.

Embodiments of the present disclosure are not limited to the above-described embodiments, and numerous additional modifications and variations are possible in light of the teachings within the technical scope of the present disclosure. It is therefore to be understood that the above-described embodiments of the present disclosure may be modified or practiced otherwise by those skilled in the art than as specifically described herein. Such modifications and variations are included in the technical scope described in the appended claims.

Aspects of the present disclosure are, for example, as follows.

First Aspect

In a first aspect, a sheet folder includes a conveyor, a pair of a first folding roller and a second folding roller, a third folding roller, a first guide, a second guide, and a motor. The conveyor conveys a sheet along a main conveyance path in a conveyance direction. The pair of the first folding roller and the second folding roller is downstream from the conveyor in the conveyance direction. The first folding roller and the second folding roller are contactable with each other to form a first nip in the main conveyance path. The third folding roller is between the first nip and the conveyor in the conveyance direction and away from the main conveyance path. The third folding roller is contactable with the second folding roller to form a second nip in a branch conveyance path branched from the main conveyance path. The second nip is between the conveyor and the first nip in the conveyance direction. The first guide is between the conveyor and the first nip in the conveyance direction. The first guide is movable between a first guide posture to guide the sheet to the first nip and a first retracted posture to guide the sheet to the second nip. The second guide is between the conveyor and the first nip in the conveyance direction and faces the first guide. The second guide is farther from the third folding roller than the first guide. The second guide is movable between a second guide posture to guide the sheet to the second nip and a second retracted posture to guide the sheet to the first nip. The motor rotates the second folding roller in a forward direction to convey the sheet toward the first nip and rotates the second folding roller in a reverse direction to convey the sheet toward the second nip. The motor moves the first guide to arrange the first guide in one of the first guide posture and the first retracted posture and moves the second guide to arrange the second guide in one of the second guide posture and the second retracted posture.

Second Aspect

In a second aspect, the sheet folder according to the first aspect further includes a driving-force transmission to transmit a rotational driving force of the motor to the first guide and the second guide, and the driving-force transmission rotates the first guide from the first retracted posture to the first guide posture and rotates the second guide from the second guide posture to the second retracted posture in conjunction with rotation of the second folding roller in the forward direction.

Third Aspect

In a third aspect, the driving-force transmission in the sheet folder according to the second aspect rotates the first guide from the first guide posture to the first retracted posture and rotates the second guide from the second retracted posture to the second guide posture in conjunction with rotation of the second folding roller in the reverse direction.

Fourth Aspect

In a fourth aspect, the sheet folder according to the third aspect has a first distance D1 from a rotation center of the first guide to a distal end of the first guide that is different from a second distance D2 from a rotation center of the second guide to a distal end of the second guide.

Fifth Aspect

In a fifth aspect, the sheet folder according to the fourth aspect has the second distance D2 longer than the first distance D1.

Sixth Aspect

In a sixth aspect, the sheet folder according to any one of the third to fifth aspects has a first rotation angle θ1 of the first guide between the first guide posture and the first retracted posture that is different from a second rotation angle θ2 of the second guide between the second guide posture and the second retracted posture.

Seventh Aspect

In a seventh aspect, the sheet folder according to the sixth aspect has the second rotation angle θ2 larger than the first rotation angle θ1.

Eighth Aspect

In an eighth aspect, the driving-force transmission in the sheet folder according to the sixth aspect transmits a rotational driving force of the motor to the first guide at a first transmission ratio R1 and to the second guide at a second transmission ratio R2, and a ratio (R2/R1) of the first transmission ratio R1 and the second transmission ratio R2 is equal to a ratio (θ2/θ1) of the first rotation angle θ1 and the second rotation angle θ2.

Ninth Aspect

In a ninth aspect, the driving-force transmission in the sheet folder according to the sixth aspect transmits a rotational driving force of the motor to the first guide at a first transmission ratio R1 and to the second guide at a second transmission ratio R2, and a ratio (R2/R1) of the first transmission ratio R1 and the second transmission ratio R2 is different from a ratio (θ2/θ1) of the first rotation angle θ1 and the second rotation angle θ2.

Tenth Aspect

In a tenth aspect, the sheet folder according to the ninth aspect has the ratio (R2/R1) of the second transmission ratio R2 to the first transmission ratio R1 larger than the ratio (θ2/θ1) of the second rotation angle θ2 to the first rotation angle θ1.

Eleventh Aspect

In an eleventh aspect, the sheet folder according to the ninth aspect has the ratio (R2/R1) of the second transmission ratio R2 to the first transmission ratio R1 smaller than the ratio (θ2/θ1) of the second rotation angle θ2 to the first rotation angle θ1.

Twelfth Aspect

In a twelfth aspect, the sheet folder according to any one of the third to eleventh aspects includes a controller that is circuitry. The controller controls the first folding roller to rotate in the forward direction to convey the sheet toward the first nip along the main conveyance path in the conveyance direction and rotate in the reverse direction to convey the sheet toward the second nip along the branch conveyance path. The controller controls the third folding roller to rotate in the forward direction to convey the sheet toward the first guide and rotate in the reverse direction to convey the sheet toward the second nip along the branch conveyance path.

Thirteenth Aspect

In a thirteenth aspect, the controller in the sheet folder according to the twelfth aspect controls the conveyor to convey the sheet toward the first nip in the conveyance direction, controls the first folding roller, the second folding roller, and the third folding roller to rotate in the reverse direction, controls the first guide to be arranged in the first retracted posture, and controls the second guide to be arranged in the second guide posture to convey the sheet to the second nip to form a first fold portion in the sheet. The controller controls the first folding roller, the second folding roller, and the third folding roller to rotate in the forward direction, controls the first guide to be arranged in the first guide posture, and controls the second guide to be arranged in the second retracted posture to convey a portion of the sheet different from the first fold portion to the first nip to form a second fold portion in the sheet.

Fourteenth Aspect

In a fourteenth aspect, the controller in the sheet folder according to the twelfth aspect controls the conveyor to convey the sheet toward the first nip in the conveyance direction, controls the first folding roller, the second folding roller, and the third folding roller to rotate in the reverse direction, controls the first guide to be arranged in the first retracted posture, and control the second guide to be arranged in the second guide posture to convey a leading edge of the sheet to the second nip. The controller controls the first folding roller, the second folding roller, and the third folding roller to rotate in the forward direction, controls the first guide to be arranged in the first guide posture, and controls the second guide to be arranged in the second retracted posture to convey a portion of the sheet different from the leading edge of the sheet to the first nip to form a fold portion in the sheet.

Fifteenth Aspect

In a fifteenth aspect, an image forming apparatus includes the sheet folder according to any one of the first to fourteenth aspects, a housing supporting the sheet folder, and an image forming section housed in the housing to form an image on the sheet to be folded by the sheet folder, and the sheet folder is detachably attachable to the housing.

Sixteenth Aspect

In a sixteenth aspect, an image forming system includes the sheet folder according to any one of the first to fourteenth aspects and an image forming apparatus connected to the sheet folder to form an image on the sheet to be folded by the sheet folder.

The above-described embodiments are illustrative and do not limit the present disclosure. Thus, numerous additional modifications and variations are possible in light of the above teachings. For example, elements and/or features of the embodiment and variation may be combined with each other and/or substituted for each other within the scope of the present disclosure.

The advantages achieved by the embodiments described above are examples and therefore are not limited to those described above.

The functionality of the elements such as controller 100 disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet folder comprising:

a conveyor to convey a sheet along a main conveyance path in a conveyance direction;

a pair of a first folding roller and a second folding roller downstream from the conveyor in the conveyance direction, the first folding roller and the second folding roller contactable with each other to form a first nip in the main conveyance path;

a third folding roller:

between the conveyor and the first nip in the conveyance direction;

away from the main conveyance path; and contactable with the second folding roller to form a second nip in a branch conveyance path branched from the main conveyance path, the second nip between the conveyor and the first nip in the conveyance direction;

a first guide between the conveyor and the first nip in the conveyance direction, the first guide movable between:

a first guide posture to guide the sheet to the first nip; and a first retracted posture to guide the sheet to the second nip;

a second guide between the conveyor and the first nip in the conveyance direction and facing the first guide, the second guide being farther from the third folding roller than the first guide, the second guide movable between:

a second guide posture to guide the sheet to the second nip; and a second retracted posture to guide the sheet to the first nip; and a motor to:

rotate the second folding roller in a forward direction to convey the sheet toward the first nip;

rotate the second folding roller in a reverse direction to convey the sheet toward the second nip;

move the first guide to arrange the first guide in one of the first guide posture and the first retracted posture; and move the second guide to arrange the second guide in one of the second guide posture and the second retracted posture, the sheet folder further comprising a driving-force transmission to transmit a rotational driving force of the motor to the first guide and the second guide, wherein the driving-force transmission:

rotates the first guide from the first retracted posture to the first guide posture and rotates the second guide from the second guide posture to the second retracted posture, in conjunction with rotation of the second folding roller in the forward direction, and rotates the first guide from the first guide posture to the first retracted posture and rotates the second guide from the second retracted posture to the second guide posture, in conjunction with rotation of the second folding roller in the reverse direction, wherein a first rotation angle $\theta 1$ of the first guide between the first guide posture and the first retracted posture is different from a second rotation angle $\theta 2$ of the second guide between the second guide posture and the second retracted posture, and wherein the driving-force transmission transmits the rotational driving force of the motor to the first guide at a first transmission ratio R1 and to the second guide at a second transmission ratio R2, and a ratio (R2/R1) of the first transmission ratio R1 and the second transmission ratio R2 is different from a ratio ($\theta 2/\theta 1$) of the first rotation angle $\theta 1$ and the second rotation angle $\theta 2$.

2. The sheet folder according to claim 1, wherein;

a first distance D1 from a rotation center of the first guide to a distal end of the first guide is different from a second distance D2 from a rotation center of the second guide to a distal end of the second guide.

3. The sheet folder according to claim 2, wherein;

the second distance D2 is longer than the first distance D1.

4. The sheet folder according to claim 1, wherein;

the second rotation angle $\theta 2$ is larger than the first rotation angle $\theta 1$.

5. The sheet folder according to claim 1, wherein;

the ratio (R2/R1) of the second transmission ratio R2 to the first transmission ratio R1 is larger than the ratio (θ2/θ1) of the second rotation angle θ2 to the first rotation angle θ1.

6. The sheet folder according to claim 1, wherein;

the ratio (R2/R1) of the second transmission ratio R2 to the first transmission ratio R1 is smaller than the ratio (θ2/θ1) of the second rotation angle θ2 to the first rotation angle θ1.

7. The sheet folder according to claim 1, further comprising:

circuitry configured to:

control the first folding roller to:

rotate in the forward direction to convey the sheet toward the first nip along the main conveyance path in the conveyance direction;

rotate in the reverse direction to convey the sheet toward the second nip along the branch conveyance path; and control the third folding roller to:

rotate in the forward direction to convey the sheet toward the first guide;

rotate in the reverse direction to convey the sheet toward the second nip along the branch conveyance path.

8. An image forming apparatus comprising:

the sheet folder according to claim 1;

a housing supporting the sheet folder; and an image forming section housed in the housing to form an image on the sheet to be folded by the sheet folder, wherein the sheet folder is detachably attachable to the housing.

9. An image forming system comprising:

the sheet folder according to claim 1; and an image forming apparatus connected to the sheet folder to form an image on the sheet to be folded by the sheet folder.

10. A sheet folder comprising:

a conveyor to convey a sheet along a main conveyance path in a conveyance direction;

a pair of a first folding roller and a second folding roller downstream from the conveyor in the conveyance direction, the first folding roller and the second folding roller contactable with each other to form a first nip in the main conveyance path;

a third folding roller:

between the conveyor and the first nip in the conveyance direction;

away from the main conveyance path; and contactable with the second folding roller to form a second nip in a branch conveyance path branched from the main conveyance path, the second nip between the conveyor and the first nip in the conveyance direction;

a first guide between the conveyor and the first nip in the conveyance direction, the first guide movable between:

a first guide posture to guide the sheet to the first nip; and a first retracted posture to guide the sheet to the second nip;

a second guide between the conveyor and the first nip in the conveyance direction and facing the first guide, the second guide being farther from the third folding roller than the first guide, the second guide movable between:

a second guide posture to guide the sheet to the second nip; and a second retracted posture to guide the sheet to the first nip; and a motor to:

rotate the second folding roller in a forward direction to convey the sheet toward the first nip;

rotate the second folding roller in a reverse direction to convey the sheet toward the second nip;

move the first guide to arrange the first guide in one of the first guide posture and the first retracted posture; and move the second guide to arrange the second guide in one of the second guide posture and the second retracted posture, the sheet folder further comprising a driving-force transmission to transmit a rotational driving force of the motor to the first guide and the second guide, wherein the driving-force transmission:

rotates the first guide from the first retracted posture to the first guide posture and rotates the second guide from the second guide posture to the second retracted posture, in conjunction with rotation of the second folding roller in the forward direction, and rotates the first guide from the first guide posture to the first retracted posture and rotates the second guide from the second retracted posture to the second guide posture, in conjunction with rotation of the second folding roller in the reverse direction, wherein the sheet folder further comprises circuitry configured to:

control the conveyor to convey the sheet toward the first nip in the conveyance direction;

control the first folding roller, the second folding roller, and the third folding roller to rotate in the reverse direction;

control the first guide to be arranged in the first retracted posture; and control the second guide to be arranged in the second guide posture, to convey the sheet to the second nip to form a first fold portion in the sheet; and control the first folding roller, the second folding roller, and the third folding roller to rotate in the forward direction;

control the first guide to be arranged in the first guide posture; and control the second guide to be arranged in the second retracted posture, to convey a portion of the sheet different from the first fold portion to the first nip to form a second fold portion in the sheet.

11. An image forming apparatus comprising:

the sheet folder according to claim 10;

a housing supporting the sheet folder; and an image forming section housed in the housing to form an image on the sheet to be folded by the sheet folder, wherein the sheet folder is detachably attachable to the housing.

12. An image forming system comprising:

the sheet folder according to claim 10; and an image forming apparatus connected to the sheet folder to form an image on the sheet to be folded by the sheet folder.

13. A sheet folder, comprising:

a conveyor to convey a sheet along a main conveyance path in a conveyance direction;

a pair of a first folding roller and a second folding roller downstream from the conveyor in the conveyance direction, the first folding roller and the second folding roller contactable with each other to form a first nip in the main conveyance path;

a third folding roller:

between the conveyor and the first nip in the conveyance direction:

away from the main conveyance path; and contactable with the second folding roller to form a second nip in a branch conveyance path branched from the main conveyance path, the second nip between the conveyor and the first nip in the conveyance direction:

a first guide between the conveyor and the first nip in the conveyance direction, the first guide movable between:

a first guide posture to guide the sheet to the first nip; and a first retracted posture to guide the sheet to the second nip:

a second guide between the conveyor and the first nip in the conveyance direction and facing the first guide, the second guide being farther from the third folding roller than the first guide, the second guide movable between:

a second guide posture to guide the sheet to the second nip; and a second retracted posture to guide the sheet to the first nip; and a motor to:

rotate the second folding roller in a forward direction to convey the sheet toward the first nip;

rotate the second folding roller in a reverse direction to convey the sheet toward the second nip;

move the first guide to arrange the first guide in one of the first guide posture and the first retracted posture; and move the second guide to arrange the second guide in one of the second guide posture and the second retracted posture, the sheet folder further comprising a driving-force transmission to transmit a rotational driving force of the motor to the first guide and the second guide, wherein the driving-force transmission:

rotates the first guide from the first retracted posture to the first guide posture and rotates the second guide from the second guide posture to the second retracted posture, in conjunction with rotation of the second folding roller in the forward direction, and rotates the first guide from the first guide posture to the first retracted posture and rotates the second guide from the second retracted posture to the second guide posture, in conjunction with rotation of the second folding roller in the reverse direction, wherein the sheet folder further comprises circuitry configured to:

control the conveyor to convey the sheet toward the first nip in the conveyance direction;

control the first folding roller, the second folding roller, and the third folding roller to rotate in the reverse direction;

control the first guide to be arranged in the first retracted posture; and control the second guide to be arranged in the second guide posture, to convey a leading edge of the sheet to the second nip; and control the first folding roller, the second folding roller, and the third folding roller to rotate in the forward direction;

control the first guide to be arranged in the first guide posture; and control the second guide to be arranged in the second retracted posture, to convey a portion of the sheet different from the leading edge of the sheet to the first nip to form a fold portion in the sheet.

14. An image forming apparatus comprising:

the sheet folder according to claim 13;

a housing supporting the sheet folder; and an image forming section housed in the housing to form an image on the sheet to be folded by the sheet folder, wherein the sheet folder is detachably attachable to the housing.

15. An image forming system comprising:

the sheet folder according to claim 13; and an image forming apparatus connected to the sheet folder to form an image on the sheet to be folded by the sheet folder.

* * * * *